US012251023B2

(12) United States Patent
Norton

(10) Patent No.: US 12,251,023 B2
(45) **Date of Patent: *Mar. 18, 2025**

(54) SYSTEMS AND METHODS FOR PROVIDING A CONVERTIBLE BENCH

(71) Applicant: M. Brent Norton, Provo, UT (US)

(72) Inventor: M. Brent Norton, Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/393,063

(22) Filed: Dec. 21, 2023

(65) Prior Publication Data

US 2024/0138575 A1 May 2, 2024

Related U.S. Application Data

(63) Continuation of application No. 17/943,054, filed on Sep. 12, 2022, now Pat. No. 11,849,850, which is a continuation of application No. 16/752,430, filed on Jan. 24, 2020, now Pat. No. 11,439,243.

(60) Provisional application No. 62/796,540, filed on Jan. 24, 2019.

(51) Int. Cl.

| | |
|---|---|
| ***A47C 13/00*** | (2006.01) |
| ***A47B 83/02*** | (2006.01) |
| ***A47B 85/04*** | (2006.01) |

(52) U.S. Cl.

CPC ..... *A47C 13/00* (2013.01); *A47B 83/024* (2017.08); *A47B 85/04* (2013.01); *A47B 2220/07* (2013.01)

(58) Field of Classification Search

None

See application file for complete search history.

(56) References Cited

U.S. PATENT DOCUMENTS

| | | | | |
|---|---|---|---|---|
| D46,770 | S | 12/1914 | Haase | |
| 1,532,417 | A | 4/1925 | Letts | |
| 4,194,784 | A | 3/1980 | Dostal et al. | |
| 4,205,876 | A * | 6/1980 | Cetina | A47D 1/103 297/118 |
| 4,211,449 | A | 7/1980 | Richardson et al. | |
| 4,382,627 | A | 5/1983 | Dean | |
| 4,385,769 | A * | 5/1983 | Molino | A61G 5/00 280/30 |
| 4,491,363 | A | 1/1985 | Kime | |

(Continued)

FOREIGN PATENT DOCUMENTS

| | | | |
|---|---|---|---|
| CA | 2115685 | A1 | 8/1995 |
| CN | 105342200 | A | 2/2016 |

(Continued)

*Primary Examiner* — David E Allred

(74) *Attorney, Agent, or Firm* — David B. Tingey; K. Russell Griggs; Kirton McConkie

(57) ABSTRACT

Systems and methods for moving a convertible bench between a first position, which presents a backrest, and a second position, which presents a tabletop, is described herein. While the described systems can include any suitable component, in some cases, they include a base having a first end piece that has a first set of legs with a first arched leg support that extends between the first set of legs and a second end piece having a second set of legs with a second arched leg support that extends between the second set of legs. The bench further includes a backrest/table portion that is hingedly coupled to the base so as to be pivotable from a first position that presents a backrest to a second position that presents a tabletop. Other implementations are described.

20 Claims, 26 Drawing Sheets

(56) References Cited

U.S. PATENT DOCUMENTS

| | | | | |
|---|---|---|---|---|
| 4,615,559 | A | 10/1986 | Blondeau | |
| 4,801,175 | A | 1/1989 | Albanese | |
| 4,913,488 | A | 4/1990 | Donnell | |
| 5,292,172 | A | 3/1994 | Watts et al. | |
| 5,609,391 | A | 3/1997 | Watts et al. | |
| 5,718,475 | A | 2/1998 | Watts | |
| 6,167,579 | B1 * | 1/2001 | Kopish | A47C 17/62 5/2.1 |
| 6,231,121 | B1 | 5/2001 | Chrisco et al. | |
| 6,241,312 | B1 | 6/2001 | Watts et al. | |
| 6,659,543 | B2 | 12/2003 | McCutcheon et al. | |
| 6,896,327 | B1 * | 5/2005 | Barile, Sr. | A47C 7/445 297/285 |
| 6,966,404 | B2 * | 11/2005 | Meeker | A47C 13/00 108/132 |
| 7,568,767 | B2 * | 8/2009 | Richardson | A47C 4/028 297/440.1 |
| 7,628,455 | B2 * | 12/2009 | Brodeur | A47C 15/004 297/312 |
| 9,526,342 | B2 * | 12/2016 | Thuma | B29C 49/0031 |
| 10,588,408 | B1 | 3/2020 | Meeks | |
| D928,520 | S | 8/2021 | Norton | |
| 11,439,243 | B2 | 9/2022 | Norton | |
| 11,696,644 | B2 * | 7/2023 | Brandtner | A47C 5/12 297/440.23 |
| 11,849,850 | B2 | 12/2023 | Norton | |
| D1,040,587 | S * | 9/2024 | Styrc | D6/709 |
| 2003/0197402 | A1 | 10/2003 | McCutcheon et al. | |
| 2005/0210816 | A1 * | 9/2005 | Kelly | E04C 5/20 52/677 |
| 2011/0316312 | A1 | 12/2011 | Boydston | |
| 2013/0099534 | A1 * | 4/2013 | Barile, Jr. | A47C 7/445 297/239 |
| 2016/0106219 | A1 | 4/2016 | Stirling | |

FOREIGN PATENT DOCUMENTS

| | | | |
|---|---|---|---|
| CN | 106852602 | A | 6/2017 |
| CN | 109247743 | A | 1/2019 |
| DE | 202011051177 | U1 | 11/2011 |
| GB | 1190221 | A | 4/1970 |
| GB | 2061096 | A | 5/1981 |
| GB | 2160767 | A | 1/1986 |
| GB | 2254780 | A | 10/1992 |

* cited by examiner

SYSTEMS AND METHODS FOR PROVIDING A CONVERTIBLE BENCH

RELATED APPLICATIONS

This is a continuation of U.S. patent application Ser. No. 17/943,054, filed on Sep. 12, 2022 (which is scheduled to issue on Dec. 26, 2023 as U.S. Pat. No. 11,849,850), and entitled SYSTEMS AND METHODS FOR PROVIDING A CONVERTIBLE BENCH; which is a continuation of U.S. patent application Ser. No. 16/752,430, filed on Jan. 24, 2020 (which issued as U.S. Pat. No. 11,439,243), and entitled SYSTEMS AND METHODS FOR PROVIDING A CONVERTIBLE BENCH, and which claims priority to U.S. Provisional Patent Application Ser. No. 62/796,540, filed Jan. 24, 2019, and entitled SYSTEMS AND METHODS FOR PROVIDING A CONVERTIBLE BENCH; the entire disclosures of which are incorporated herein by reference.

BACKGROUND OF THE INVENTION

Field of the Invention

The present invention relates to furniture. More particularly, some implementations of the described invention relate to systems and methods for providing a convertible bench that is configured to move between a first position, which presents a backrest, and a second position, which presents a tabletop. While the described bench can include any suitable component, in some cases, it includes a base having a first end piece that has a first set of legs with a first arched leg support that extends between the first set of legs and a second end piece having a second set of legs with a second arched leg support that extends between the second set of legs. The bench further includes a backrest/table portion that is hingedly coupled to the base so as to be pivotable from the first position that presents the backrest to a second position that presents the tabletop. In some cases, an armrest of the backrest/table portion defines an arched recess that provides strength to the armrest while reducing an amount of material needed to produce the armrest.

Background and Related Art

Often times, people desire to sit down to relax, to talk with others, to wait or pass time, to enjoy their surroundings, and to otherwise rest from standing, while still being in an upright position. In many cases, having a seat with a backrest can further allow a person to use the backrest for support, such that the person can sit comfortably for a relatively long period of time.

In some cases, in addition to (or in place of) having a seat with a backrest, it is also nice to have a table where a person can: place one or more objects (e.g., plates, cups, utensils, food, drinks, laptops, decorations, and/or any other suitable objects), rest one's arms, work, and otherwise use a flat surface. Accordingly, in some cases, it is desirable to have both a bench with a backrest and a table.

In this regard, a wide variety of chairs with backrests and wide variety of tables exist. By way of example, there many different benches with backrests (e.g., park benches) and many different tables (e.g., picnic tables) that are commercially available. In some cases, however, it can be costly to purchase both a bench and a table. Additionally, in some cases, it can take up a relatively large amount of space to have both a table and bench with a backrest. As a result, in some cases, it can be difficult to have both a table and a separate bench having a backrest.

Thus, while systems and methods currently exist that are used to provide tables and benches with backrests, some challenges still exist, including those listed above. Accordingly, it would be an improvement in the art to augment or even replace current techniques with other techniques.

SUMMARY OF THE INVENTION

The present invention relates to furniture. More particularly, some implementations of the described invention relate to systems and methods for providing a convertible bench that is configured to move between a first position, which presents a backrest, and a second position, which presents a tabletop. While the described bench can include any suitable component, in some cases, it includes a base having a first end piece that has a first set of legs with a first arched leg support that extends between the first set of legs and a second end piece having a second set of legs with a second arched leg support that extends between the second set of legs. The bench further includes a backrest/table portion that is hingedly coupled to the base so as to be pivotable from the first position that presents the backrest to a second position that presents the tabletop. In some cases, an armrest of the backrest/table portion defines an arched recess that provides strength to the armrest while reducing an amount of material needed to produce the armrest.

In some cases, each of the end pieces defines one or more openings between a highest part of the arched leg support that extends between the set of legs and a highest part of the end piece. While such openings can have any suitable shape, in some cases, an upper portion of such openings optionally comprises an arch shape that provides additional strength the corresponding end piece. Although such openings can be completely open and/or unobstructed, in some cases, one or more supports are disposed in the openings to provide additional strength to the end pieces. Thus, by having one or more of the openings be at least partially defined by and/or by having supports disposed in one or more of the openings, some implementations of the end pieces are configured to use a relatively small amount of material (e.g., PVC and/or any other suitable material) to construct the end pieces, while such end pieces are still provided with additional strength.

In some implementations, the described bench further comprises one or more cross members that extend between the two end pieces and that provide support to a sitting surface that is coupled to the end pieces. While such a cross member can be disposed in any suitable location, in some cases, it is coupled to both the first arched leg support and the second arched leg support. Indeed, in some cases, the cross member is disposed between an uppermost portion and a lowermost portion of an apex (or key) of the first and second arches (or arched leg supports). In some other cases, the cross member is disposed at (and coupled to) the end pieces above the apex of the first and second arches (or arched leg supports). In some such cases, the arches in the end pieces and the placement of the cross member with respect to the arches provide the bench with additional strength than may otherwise be possible without the arches and cross member placement, while still reducing the amount of material needed to form the bench.

In some implementations, the backrest/table portion comprises a first and second armrest component that each pivotally attach the backrest/table portion to the bench's base (e.g., via the first and second end pieces, respectively).

In some cases, each armrest component includes an armrest base and/or an armrest cap (with such components being integrally formed together or being formed separately and then being joined together in any suitable manner). In some cases, the armrest base comprises a first pivot joint (or hinge) that pivotally couples the armrest base to a corresponding end piece. In some cases, each armrest base further comprises a first contact surface or stop that is configured to contact a first portion of the corresponding end piece (e.g., a top, back surface of the end piece) when the backrest/table portion is in the first position, and a second contact surface that is configured to contact a second portion (e.g., a top, front portion) of the corresponding end piece when the backrest/table is in the second position. In some such cases, each armrest base defines an arch-shaped recess that is disposed between the first pivot joint and the first contact surface. In some cases, such an arch-shaped recess provides increased strength to the armrest component, while significantly reducing the amount of material needed to produce (and/or a weight of) the armrest component.

In some cases, in order to ensure that movement of the backrest/table portion of the bench is properly limited, the second contact of the surface of each of the armrest bases comprises a first substantially flat surface that runs at a first angle with respect to an uppermost surface of the corresponding end piece when the bench is in the first position. Additionally, in some cases, each end of the backrest/table portion comprise an end support that couples one or more support elements (e.g., planks, beams, sheets of material, and/or any other suitable structures that serve as the bench's backrest and tabletop) to the corresponding armrest components. In some such cases, the end supports each run at a second angle with respect to the uppermost surface of the corresponding end piece when the bench is in the first position. In this regard, in some embodiments, the first angle of the second contact surface and the second angle of the end supports is the same angle (or parallel) when the bench is the first position. In some other embodiments, the first angle of the second contact surface and the second angle of the end supports comprise divergent angles when the bench is the first position. Indeed, in some embodiments, the backrest/table portion comprises one or more adjustment mechanisms that allow the angles of the end supports (and/or any other suitable portion of the bench) to be varied to selectively adjust the slope of the bench's backrest when the bench is in the first position.

Although in some implementations, the armrest cap of each of the armrest components comprises a substantially flat uppermost surface, in some other implementations, each armrest cap comprises an arch-shaped upper surface. In some such cases, such an arch-shaped surface provides additional strength to the corresponding armrest component—thus allowing the corresponding armrest component to be relatively strong, while requiring a relatively small amount of material to construct the armrest component.

While the methods and processes of the present invention may be particularly useful for providing outdoor furniture (e.g., picnic tables that convert into benches with a backrest, and vice versa), those skilled in the art will appreciate that the described systems and methods can be used in a variety of different applications and in a variety of different areas of manufacture. For instance, the described systems and methods can be used not only with outdoor furniture, but some implementations of the described systems and methods are configured to be used in any other suitable location and/or application. Indeed, in some implementations, the described systems and methods are used for (and/or modified to be) other forms of furniture, including, without limitation, convertible dining room tables (e.g., dining room tables (and/or any other suitable type of tables) that convert from a sitting surface with a table into a sitting surface with a backrest, and vice versa); convertible personal desks (e.g., desks that convert from a seat with a personal desk to a seat with a backrest, and vice versa); convertible couches, love seats, and other padded chairs (e.g., couches, love seats, and other padded chairs having a backrest and that are configured to convert into tables having a padded chair surface, and vice versa); furniture that comprises a container (e.g., a toy bin, a chest, a drawer, and/or any other suitable container) and seat and that is configured to convert between a being seat with a backrest to a seat with a tabletop and vice versa; and for any other suitable type of furniture.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other features and advantages of the present invention are obtained, a more particular description of the described inventions will be rendered by reference to specific embodiments thereof, which are illustrated in the appended drawings. Understanding that the drawings are not necessarily drawn to scale or in proper proportion, and that the drawings depict only typical embodiments of the present inventions and are not, therefore, to be considered as limiting the scope of the inventions, the present inventions will be described and explained with additional specificity and detail through the use of the accompanying drawings in which.

DETAILED DESCRIPTION OF THE INVENTION

The present invention relates to furniture. More particularly, some embodiments of the described invention relate to systems and methods for providing a convertible bench that is configured to move between a first position, which presents a backrest, and a second position, which presents a tabletop. While the described bench can include any suitable component, in some cases, it includes a base having a first end piece that has a first set of legs with a first arched leg support that extends between the first set of legs and a second end piece having a second set of legs with a second arched leg support that extends between the second set of legs. The bench further includes a backrest/table portion that is hingedly coupled to the base so as to be pivotable from the first position that presents the backrest to a second position that presents the tabletop. In some cases, an armrest of the backrest/table portion defines an arched recess that provides strength to the armrest while reducing an amount of material needed to produce the armrest.

Figure 1:
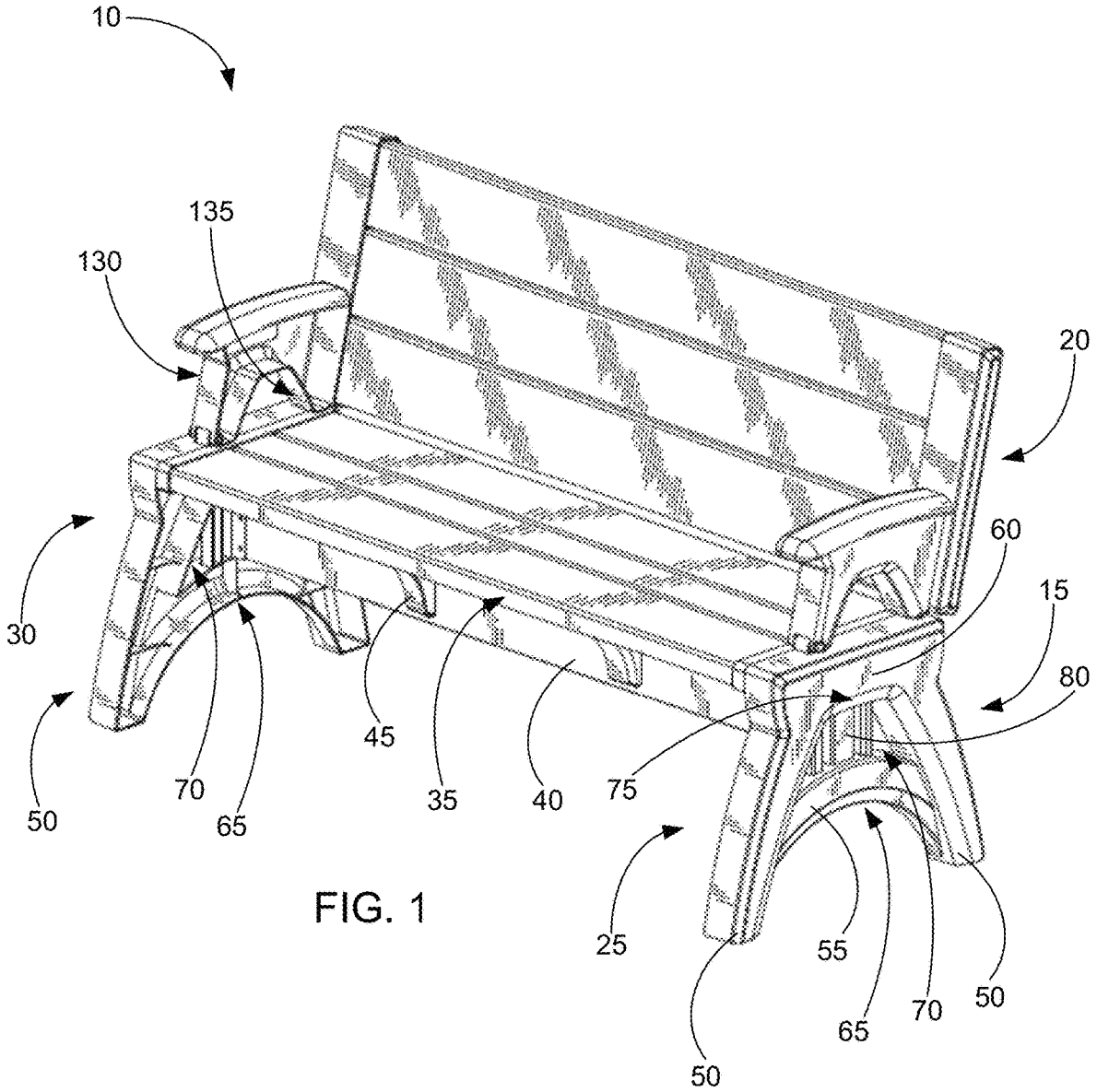
FIG. 1 illustrates a front perspective view of a convertible bench in a first position in accordance with a representative embodiment.
Figure 2:
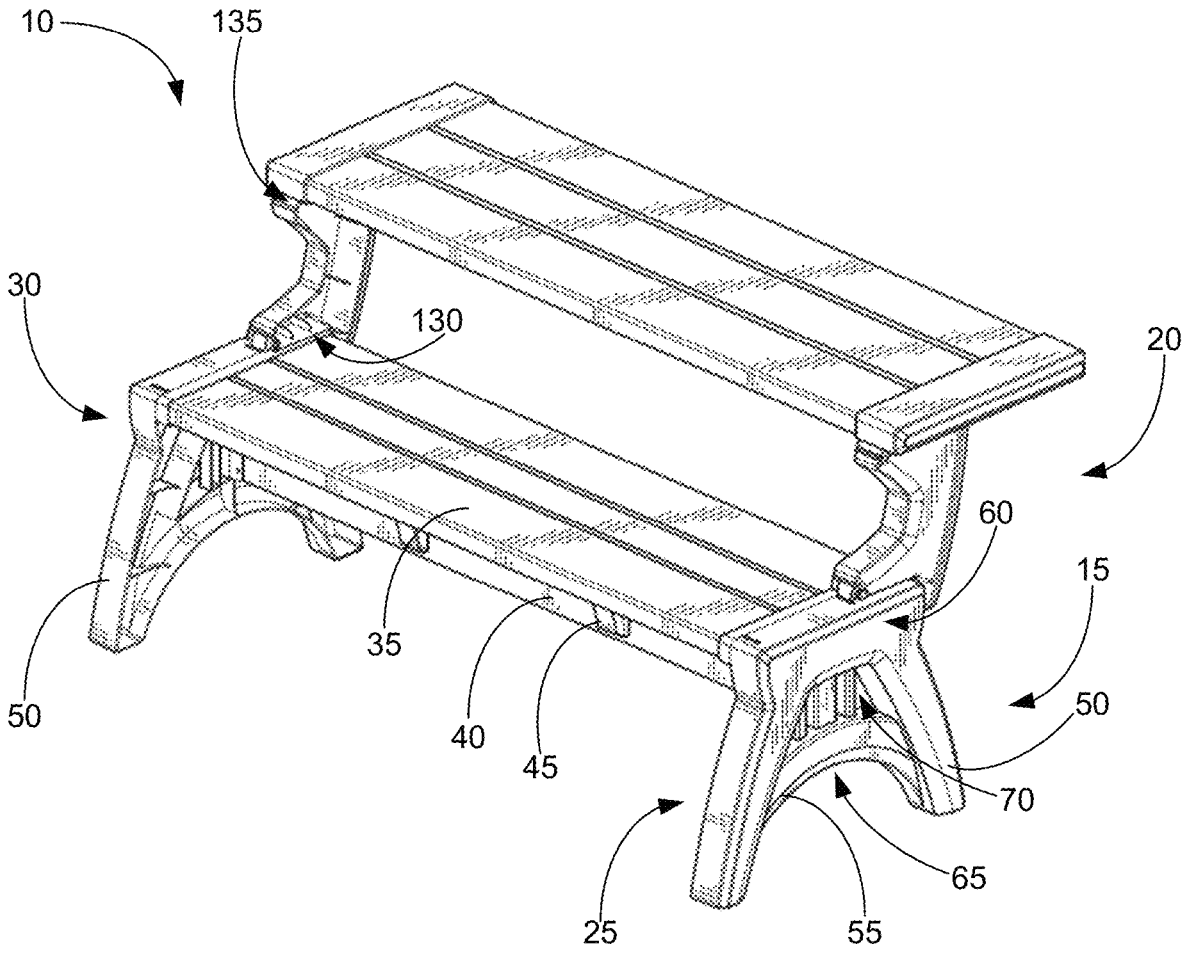
FIG. 2 illustrates a front perspective view of the convertible bench in a second position in accordance with a representative embodiment.

The described convertible bench can comprise any suitable component that allows a backrest/table portion of the bench to pivot from a first position that presents a backrest (e.g., as shown in FIG. 1) to a second position that presents a tabletop (e.g., FIG. 2). By way of non-limiting illustration, FIGS. 1-2 show a representative embodiment in which the described convertible bench 10 comprises a base portion 15 having a backrest/table portion 20 that is pivotally coupled to the bench's base such that the backrest/table portion can pivot from the first position to the second position (and vice versa).

With respect to the bench's base portion 15 (or simply the base), the base can comprise any suitable component that allows it to provide a sitting surface and to have the backrest/table portion 20 be pivotally coupled thereto. By way of non-limiting illustration, FIGS. 1-2 show that in some embodiments, the base 15 comprises one or more end pieces (e.g., a first end piece 25 and a second end piece 30), sitting surfaces 35, cross members 40, and/or struts 45.

With reference to the end pieces 25 and 30, the end pieces can comprise any suitable feature that allows them to support and couple to the sitting surface 35 and that otherwise allows the bench 10 to function as described herein. By way of non-limiting illustration, FIGS. 1-2 show that, in some embodiments, the end pieces 25 comprise one or more legs 50, leg supports 55, and/or sitting surface supports 60.

In this regard, each end piece (25 and 30) can comprise any suitable number of legs 50 (or contact surfaces that are configured to support the bench 10 on the ground, a floor, and/or any other suitable support surface; each of which may be referred to herein as a floor surface). Indeed, while some embodiments of the end pieces each have only a single leg, other embodiments, have 2, 3, 4, or more. By way of non-limiting illustration, FIGS. 1-2 show some embodiments in which each end piece 25 and 30 comprises a set of legs 50 (e.g., two).

Figure 10:
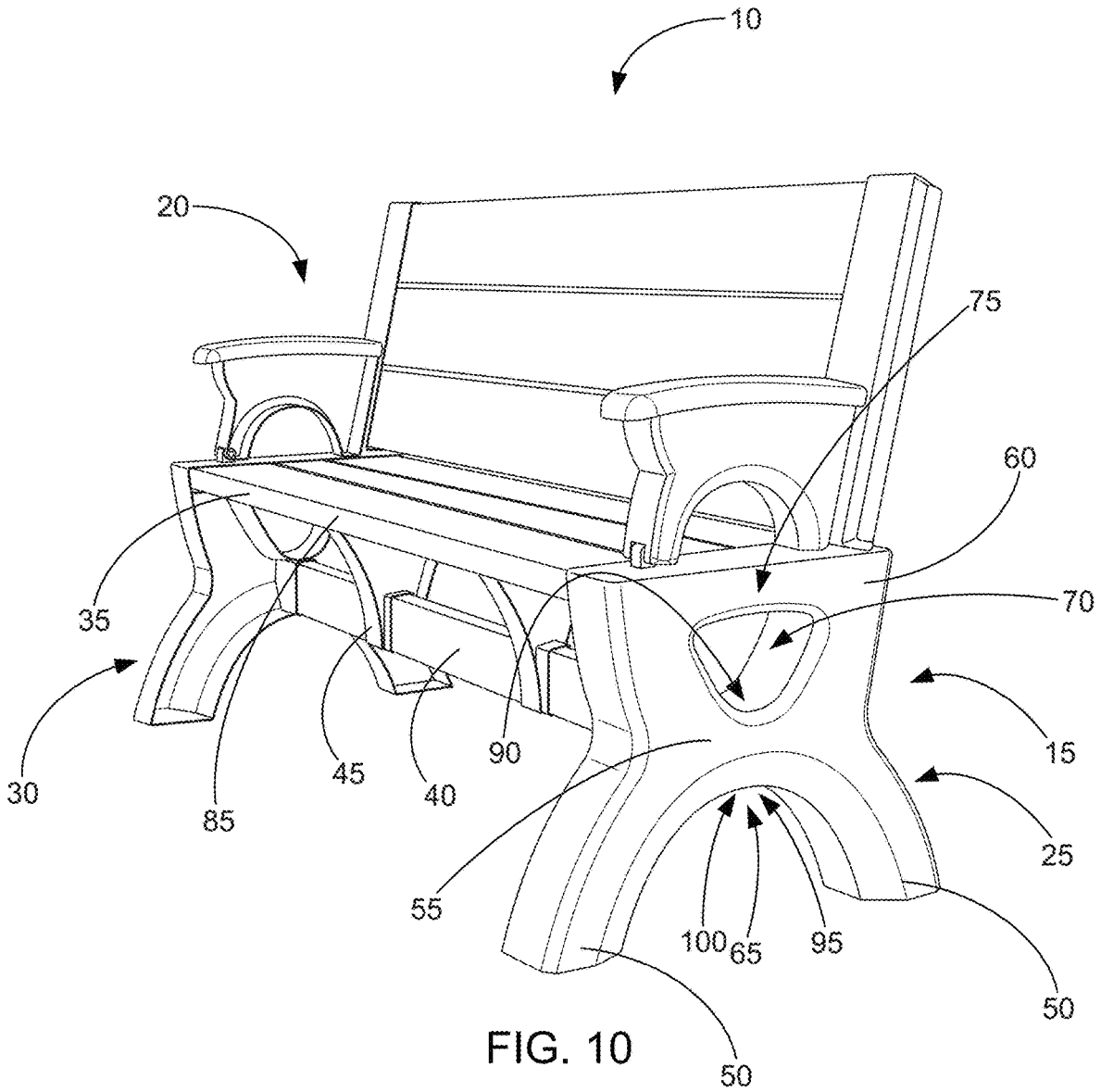
FIGS. 10-12 illustrate various views of the convertible bench in accordance with some embodiments.
Figure 11:
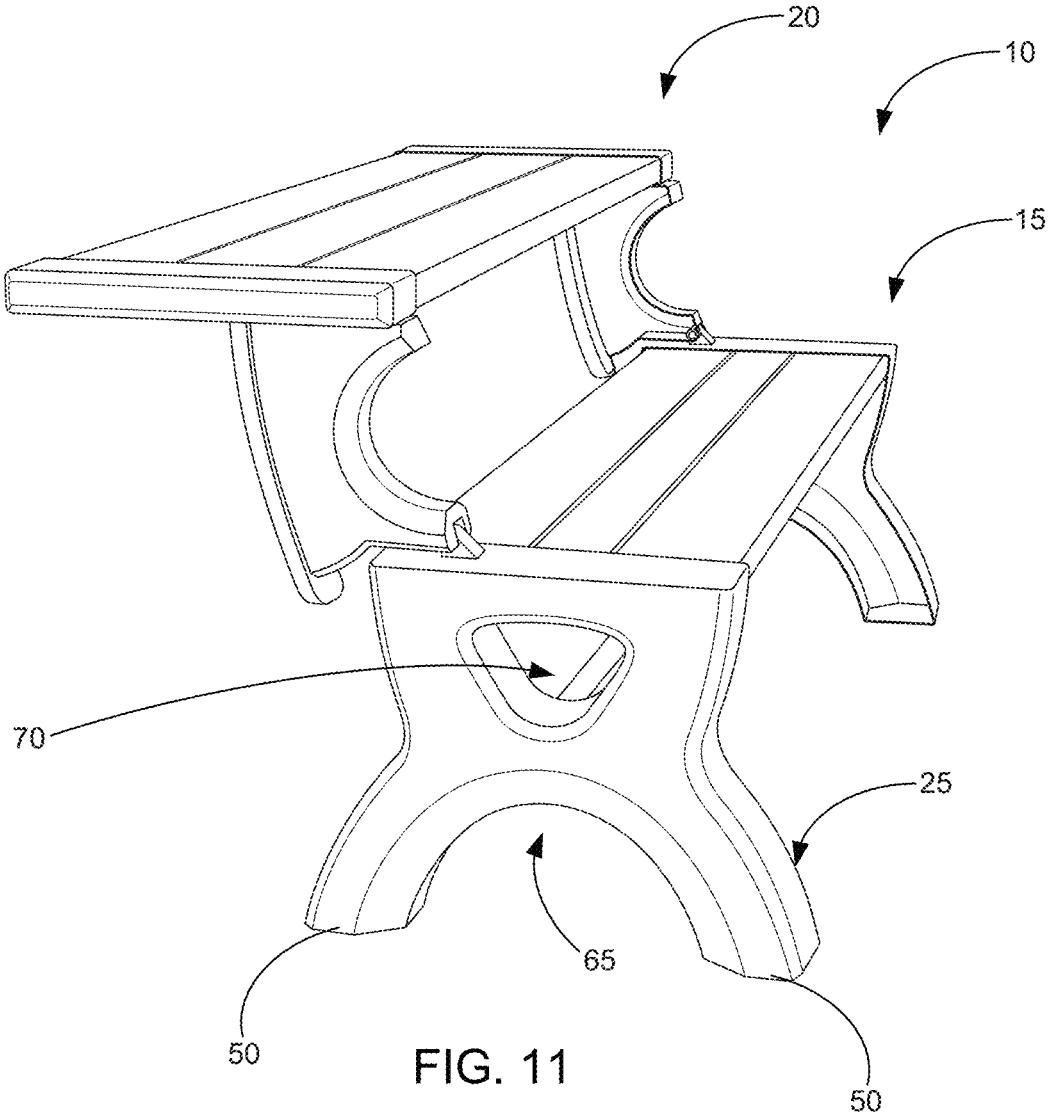
Figure 12:
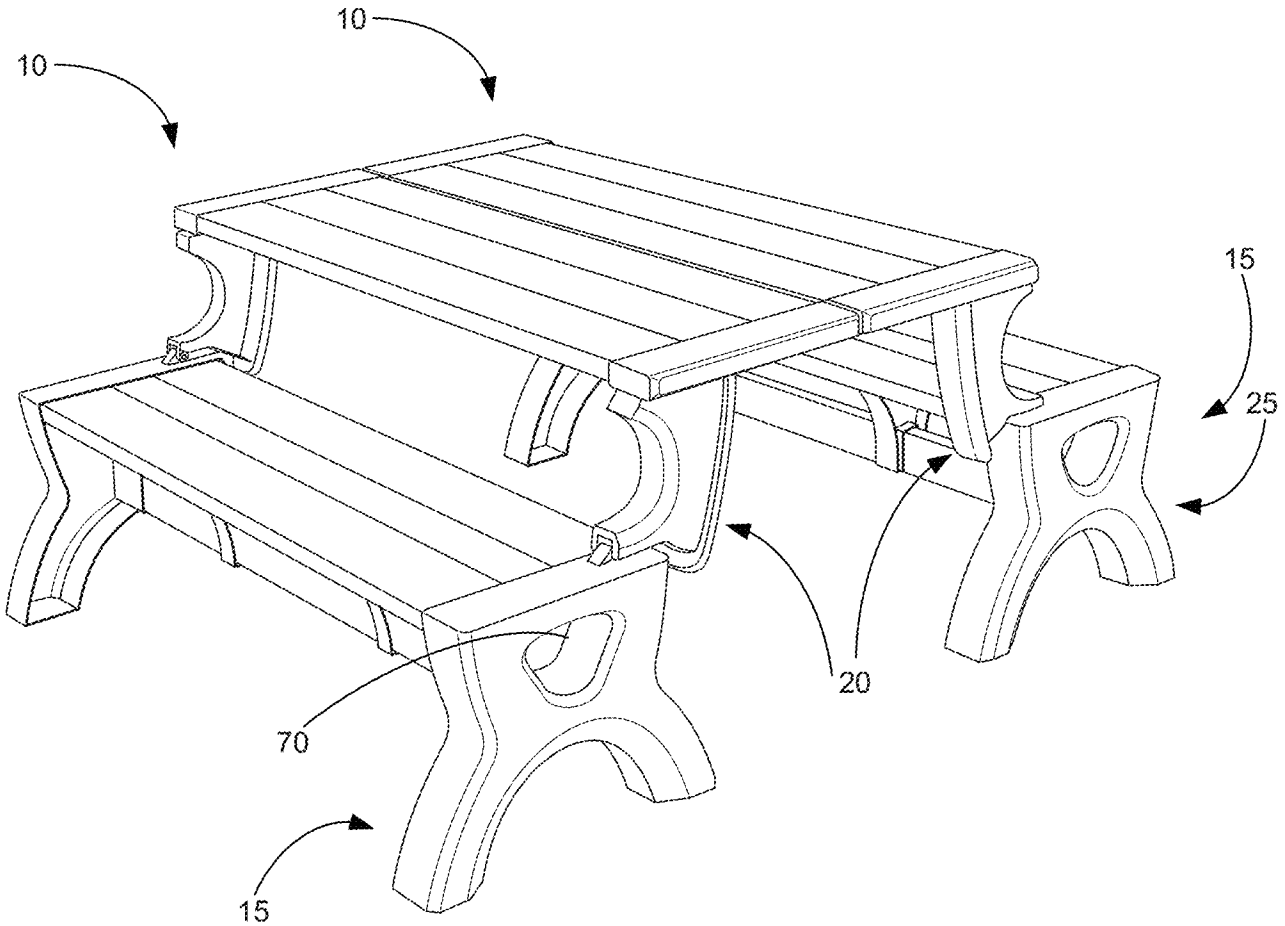
Figure 13A:
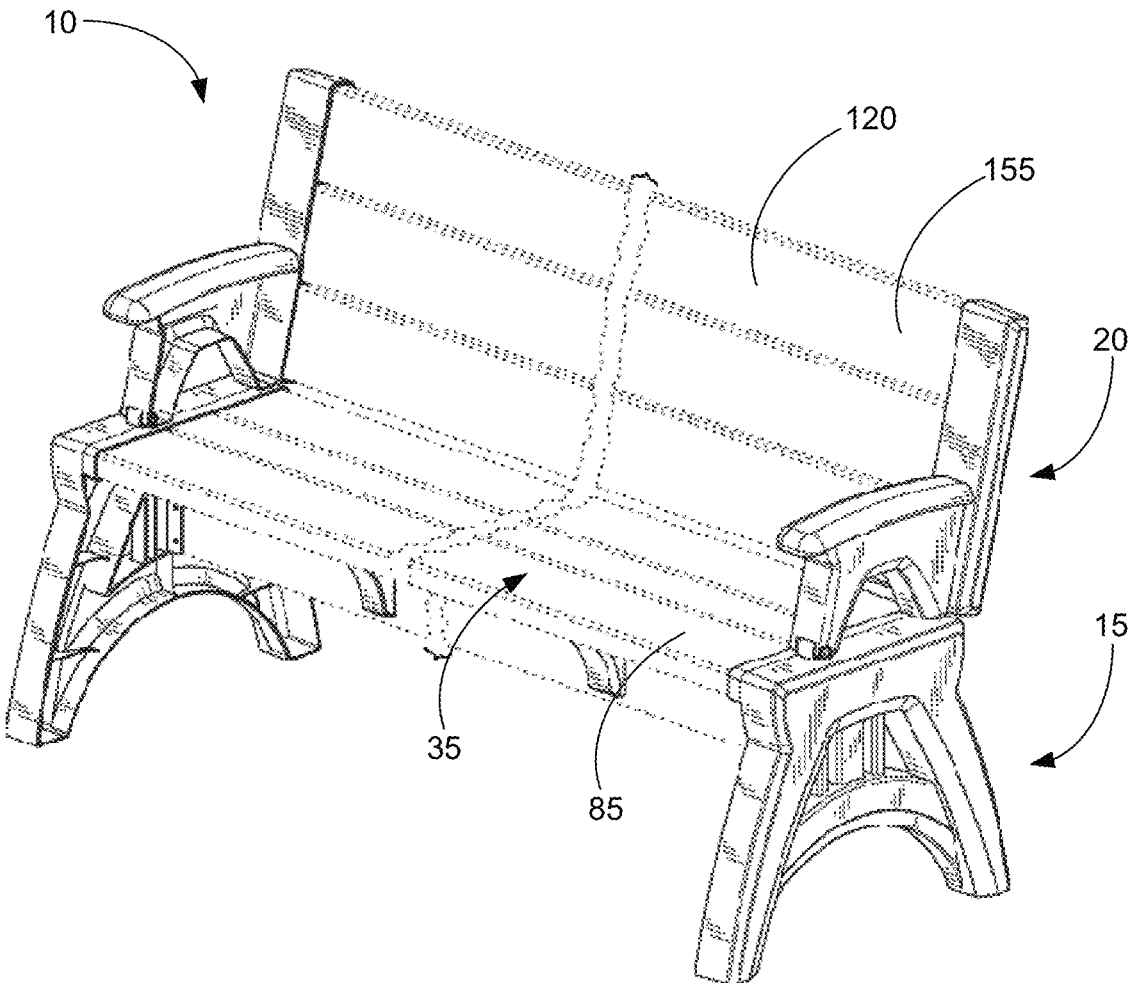
FIGS. 13A-13G each illustrate a different view of end portions of the convertible bench in accordance with some embodiments.
Figure 13B:
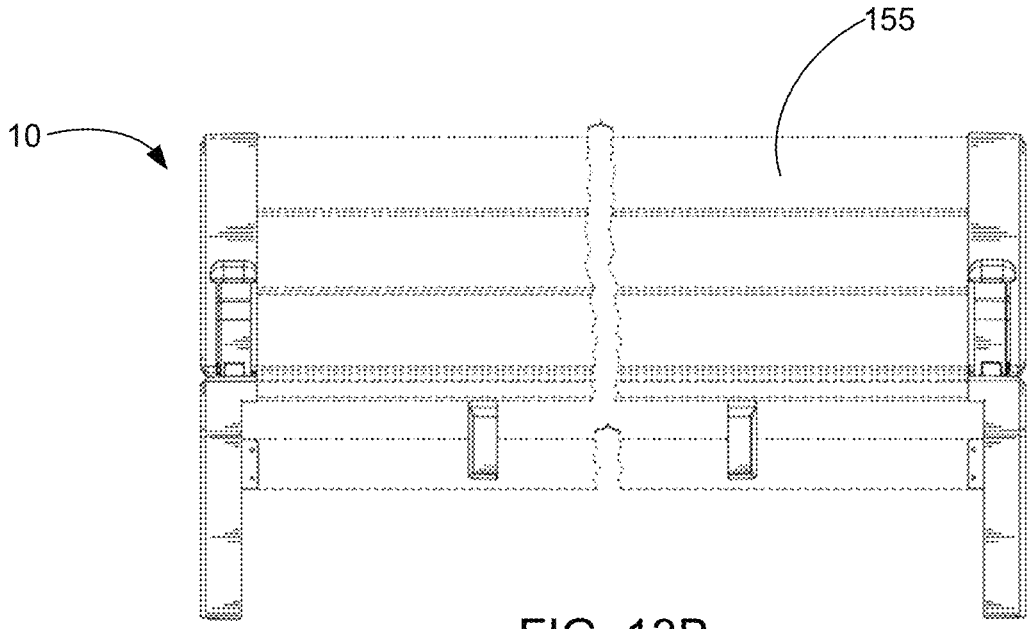
Figure 13C:
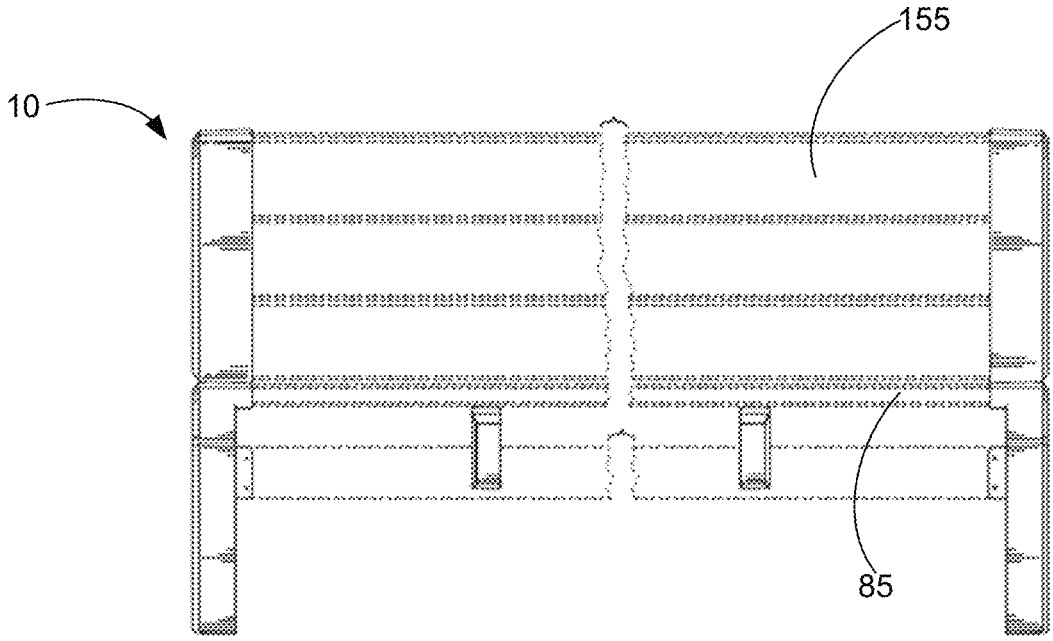
Figure 13D:
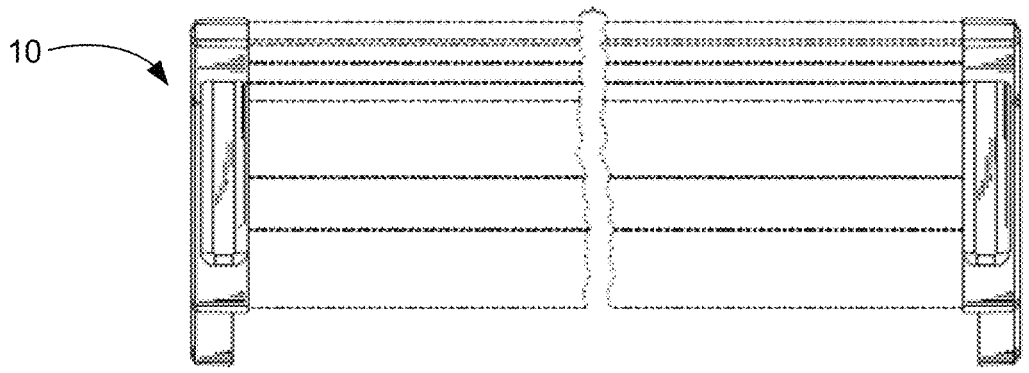
Figure 13E:
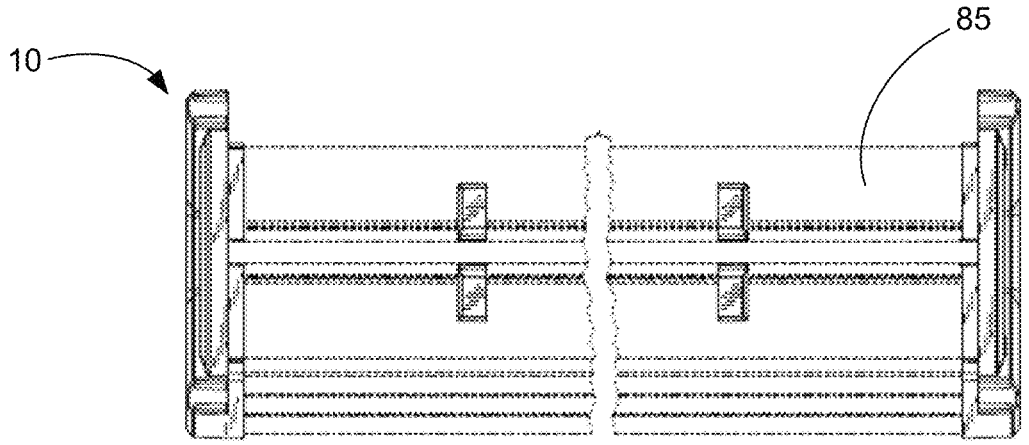
Figure 13F:
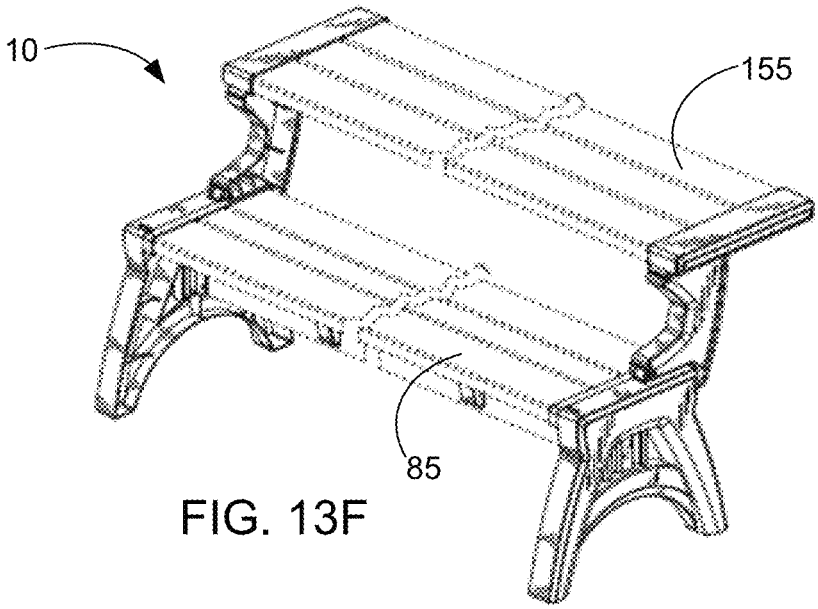
Figure 13G:
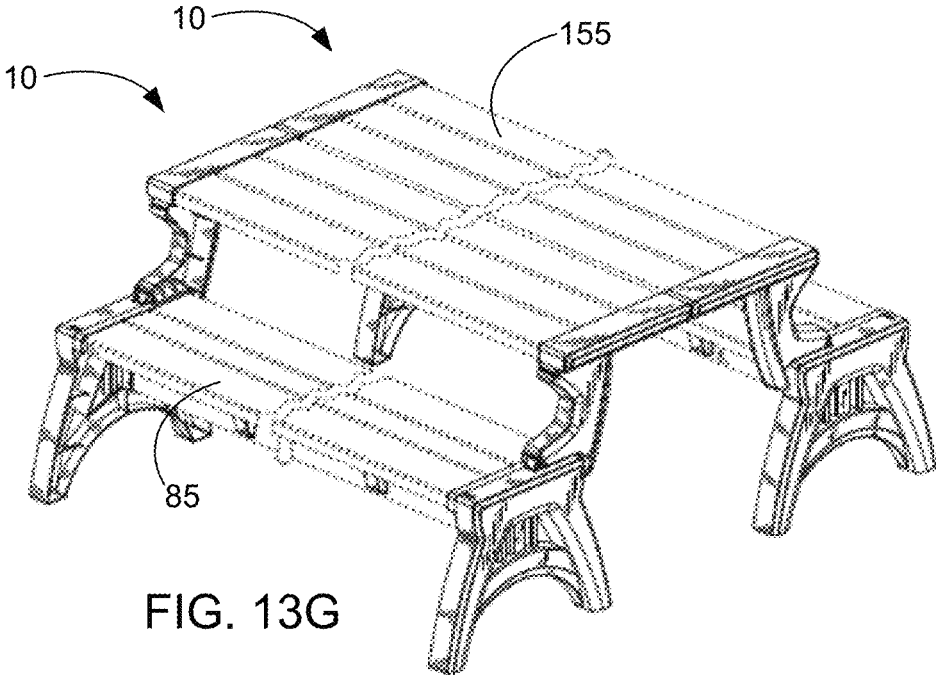

Although the legs 50 can be coupled together at any suitable location (e.g., at their lowermost end, their uppermost end, anywhere in between, and/or at any other suitable portion of the legs' corresponding end piece 25 or 30), in some cases, the legs couple together at the sitting surface support 60 and/or at the leg support 55 (e.g., as shown in FIGS. 1-2). In this regard, the leg support can be any suitable shape and have any suitable feature that allows it to hold the legs together and to otherwise support the bench 10. For instance, some embodiments of the leg support comprise one or more arches, trusses, scaffolds, beams, planks, boards, tethers, and/or other suitable support structures. By way of non-limiting illustration, FIGS. 1-2 (and FIGS. 6, 10, and 12) show some embodiments in which the legs 50 of the end pieces 25 and/or 30 are coupled together by (and/or otherwise comprise) an arch 65 or an arched leg support.

Where the end pieces 25 and 30 each comprise a pair of legs 50 that are coupled together by, that are formed with, and/or that otherwise comprise one or more arched leg supports 65 (or arches), the arches can each comprise any suitable type of arch, including, without limitation, a rounded arch, a one-centered arch, a semicircular arch, a two-centered arch, a pointed segmental arch, a drop arch, an equilateral arch, a lancet arch, a gothic arch, an equilateral gothic arch, a lancet gothic arch, a drop gothic arch, a three-centered arch, a basket-handle arch, a four-centered arch, a circular-based arch, a Tudor arch, a segmental arch, a pseudo three-centered arch, a pseudo four-centered arch, a horseshoe arch, an onion arch, a relieving arch, a cinquefoil arch, a shouldered arch, an inflexed arch, a rampart arch, a parabolic arch, a draped arch, a trefoil arch, an ogee arch, a multi-foil arch, a multi-centered arch, a nested arch, a venetian arch, a bell arch, a vaulted arch, an elliptical arch, a reverse ogee arch, a pointed arch, a semi-elliptical arch, a stilted arch, a Florentine arch, a camber arch, a curved top arch, a pointed top arch, a cathedral top arch, a true arch, an anse de panier arch, a stilted, a pipe arch, a low profile arch, a high profile arch, a trapezoidal arch, and/or any other suitable type of arch. By way of non-limiting illustration, FIGS. 1-2 and 5-6 show some embodiments in which the leg support 55 comprises a rounded (or one-centered) arched leg support 65. Similarly, FIG. 10 shows an embodiment in which the leg support 55 comprises a semicircular arched leg support 65.

Where the leg support 55 comprises an arched leg support 65, the arched leg support can serve any suitable function. Indeed, in some embodiments, the arched leg support holds two or more legs 50 together and otherwise supports and reinforces the bench 10. Additionally, in some embodiments, the arched leg support provides more strength to the bench, while requiring less building material for the bench's construction. As a result, use of the arched leg support makes some embodiments of the bench 10 stronger than other embodiments that lack the arched leg support. Moreover, as use of the arched leg support does, in some embodiments, provide the bench with additional strength while reducing the amount of material needed to construct the bench, in some such embodiments, use of the arched leg support reduces the overall weight of the bench and while saving money by reducing the amount of building materials required to build the bench.

Although some embodiments of the end pieces 25 and 30 are solid (e.g., do not comprise an opening) between the leg support 55 (e.g., the arched leg support 65) and an upper end of the sitting surface support 60, in some other embodiments, one or more of the end pieces defines one or more recess and/or openings between the leg support and the sitting surface support. By way of non-limiting illustration, FIGS. 1-2, 5-6, and 10-12 show some embodiments in which the end pieces (e.g., 25 and 30) define one or more openings 70 that extend though the end pieces.

Where the end pieces 25 and/or 30 define one or more openings 70 that extend through the end pieces, such openings can be any suitable shape, including, without limitation, being: arch-shaped (or having a rounded arch-shaped portion), circular, elliptical, triangular, rounded triangular, square, rounded square, trapezoidal, rounded trapezoidal, diamond, polygonal, rounded polygonal, crescent-shaped, arch-shaped, regular, irregular, symmetrical, asymmetrical, rounded (e.g., to avoid stress risers and/or to distribute weight), and/or any other suitable shape that allows the bench 10 to function as described herein. Indeed, in some embodiments an upper portion of the opening defines or comprises an arch shape (e.g., to provide additional strength to the end pieces). By way of non-limiting illustration, FIG. 1 shows an embodiment in which a portion of the opening 70 has a rounded trapezoidal arch shape (or an upper portion 75 having a rounded trapezoidal arch shape). Moreover, FIG. 10 shows an embodiment in which the opening 70 has a rounded triangular shape, comprising an upper portion 75 having an arch shape. In this regard, an arch shape at the upper portion of the opening gives some embodiments of the bench unexpected and surprising strength, while reducing the bench's weight and materials costs.

Figure 6:
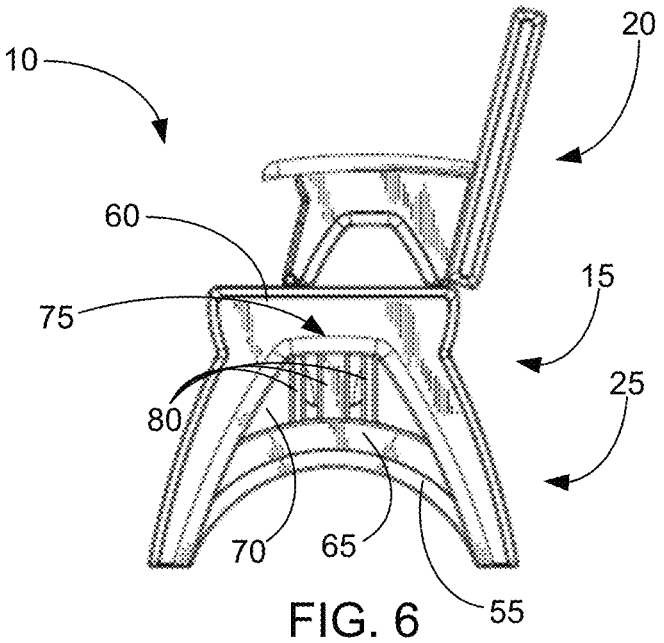
Figure 7:
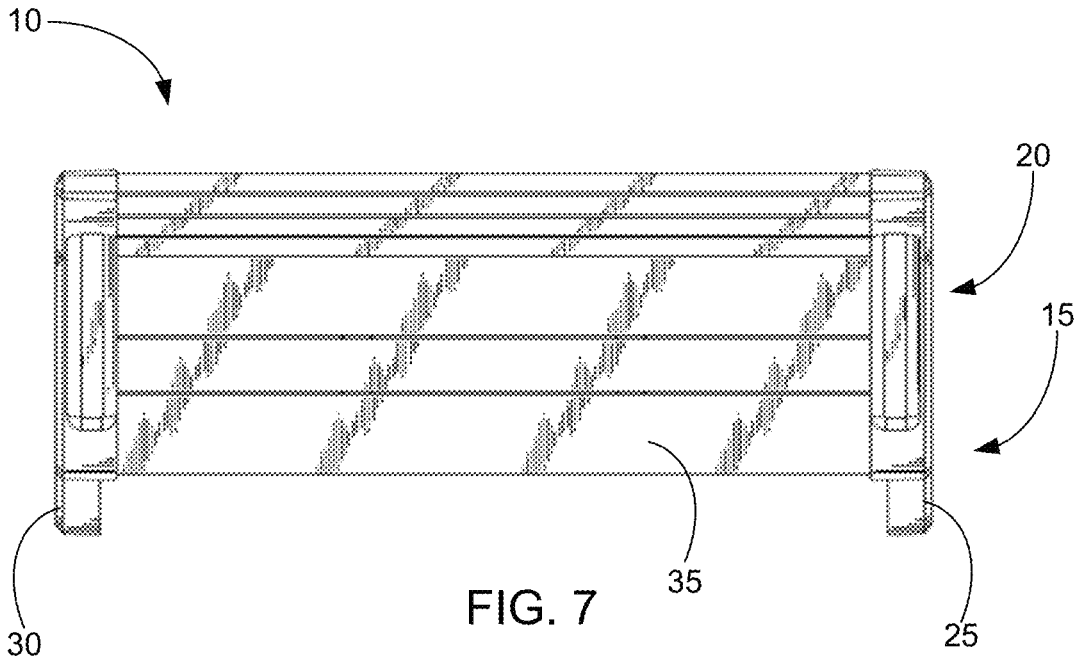
FIG. 7 illustrates a top plan view of the convertible bench of FIG. 1.
Figure 8:
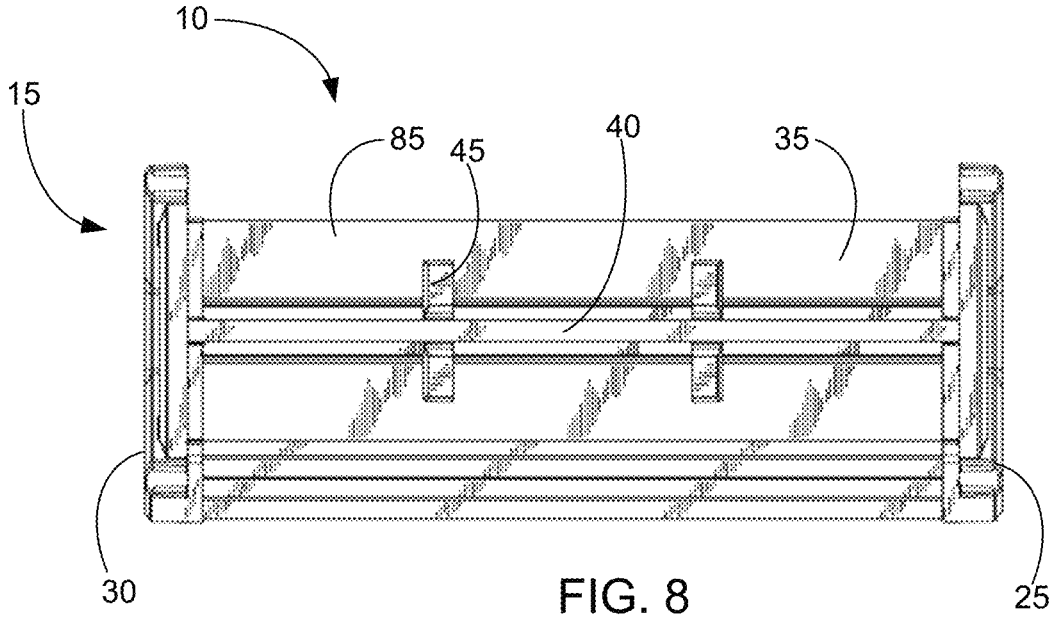
FIG. 8 illustrates a bottom plan view of the convertible bench of FIG. 1.
Figure 9:
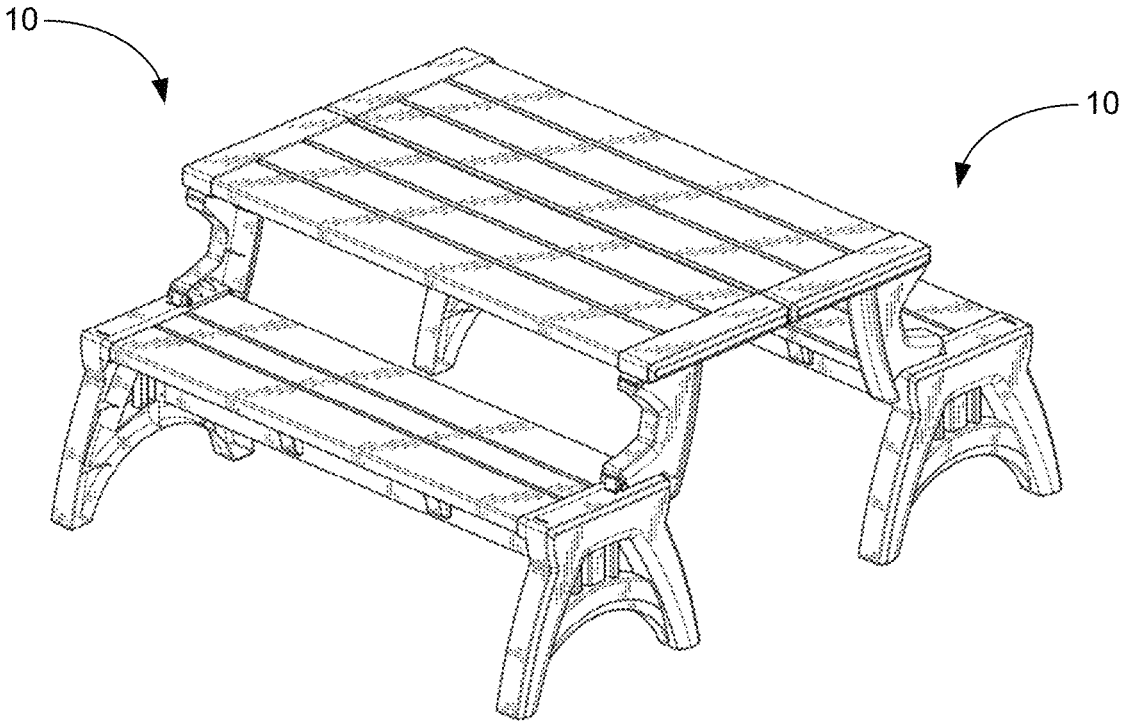
FIG. 9 illustrates a perspective view of two convertible benches that are in the second position and that are placed together in accordance with a representative embodiment.

Although some embodiments of the opening 70 are left completely open (e.g., as shown in FIG. 10), in some other embodiments, the opening comprises one or more scaffolds, decorative supports that strengthen an end piece 25 and/or 30, columns, frameworks, braces, skeletons, ribs, and/or other support members. By way of non-limiting illustration, FIGS. 1 and 6 show some embodiments in which the opening 70 comprises, is divided by, defined by, and/or otherwise includes one or more vertical supports 80 that extend between the arched leg support 65 and the sitting surface support 60 portion of the bench 10. In this regard, while such vertical supports can perform any suitable function, in some embodiments, they strengthen the end pieces (e.g., giving strength from the leg support 55 (or the arched leg support 65) to the sitting surface support 60). Accordingly, in some embodiments, such supports strengthen the bench 10 while reducing the weight of and/or amount of materials need to construct some embodiments of the bench.

With reference now to the sitting surface 35, the bench 10 can comprise any suitable sitting surface that is capable of supporting one or more users. Some non-limiting examples of suitable sitting surfaces include one or more planks, boards, beams, laths, supports, frameworks, weaves, sheets, and/or any other suitable pieces or types of material, including, but not limited to, one or more types of polyvinyl chloride (PVC), plastics, polymers, wood, stone, ceramics, composites, metals, alloys, natural materials, synthetic materials, wicker, and/or any other suitable material. By way of non-limiting illustration, FIGS. 1 and 10 show some embodiments in which the sitting surface 35 comprises one or more planks 85 (e.g., PVC planks). In this regard, such planks can be any suitable size, including, without limitation, being about 1.5 inches (±1 inch) in height, by about 3.5 inches (±3 inches) in width, and by any suitable length (e.g., between about 1 foot and about 50 feet, or in any subrange thereof, such as between about 5 feet and about 10 feet; see e.g., FIGS. 13A-13G). Indeed, in some embodiments, the sitting portion and the backrest portion (as described below) are between about 1.5 feet and about 12 feet (e.g., between about 2 feet and about 8 feet).

The sitting surface 35 can be supported by the end pieces 25 and 30 in any suitable manner that allows the bench 10 to function as described herein. Indeed, in some embodiments, the sitting surface (e.g., one or more planks 85) is coupled to the end pieces by resting on top of, hanging below, being inserted into, being fastened to, and/or by otherwise being coupled to the end pieces (e.g., the sitting surface support 60). By way of non-limiting illustration, FIGS. 1-12 (or FIG. 3 in particular) show some embodiments in which the sitting surface 35 is (or planks 85 are) inserted into (and/or otherwise coupled to) the end pieces 25 and 30.

With reference now to the struts 45, some embodiments of the bench 10 optionally include 1, 2, 3, 4, 5, or more struts that are coupled to the cross member 40 and the sitting surface 35 (e.g., one, multiple, and/or all of the planks 85). While such struts can perform any suitable function, in some embodiments, they help support the sitting surface (e.g., by bracing the sitting surface against the cross member) and prevent the sitting surface from bowing and/or sagging.

Where the bench 10 comprises one or more struts 45, the struts can couple to the cross member 40 and/or the sitting surface 35 in any suitable manner. Indeed, in some embodiments, one or more of the struts couple to the cross member (e.g., via one or more tongue and groove connections, fasteners, adhesives, welds, clamps, catches, frictional engagements, mechanical engagements, and/or other suitable coupling mechanisms) and fan out (or broaden) to contact, couple to, and/or support the sitting surface 35 or (as shown in FIGS. 1, 3, 8, and 10) to support each of the planks 85.

Figure 14B:
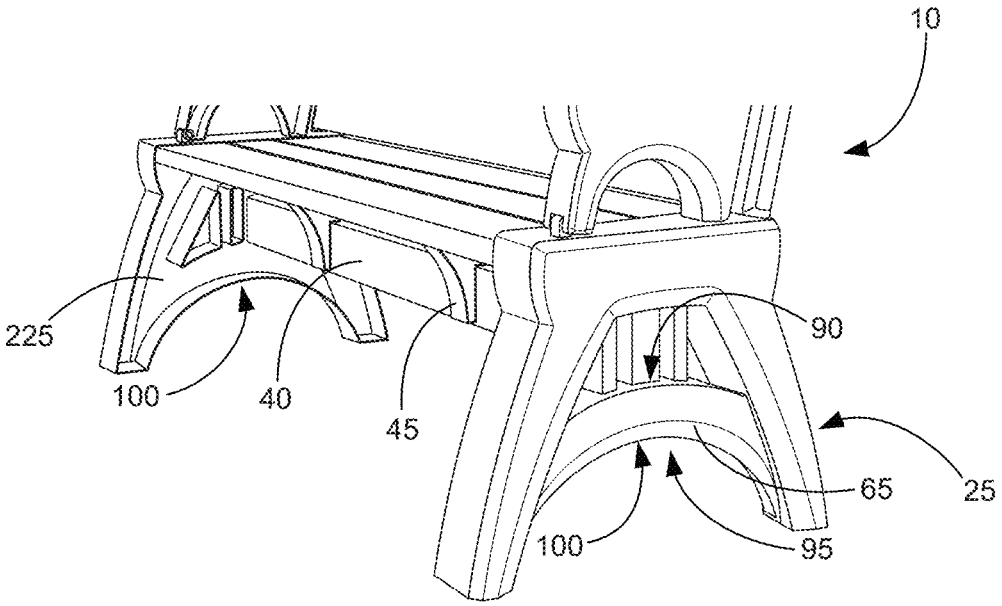
FIGS. 14A-14B each depict a perspective view showing a portion of the convertible bench in accordance with some embodiments.
Figure 14A:
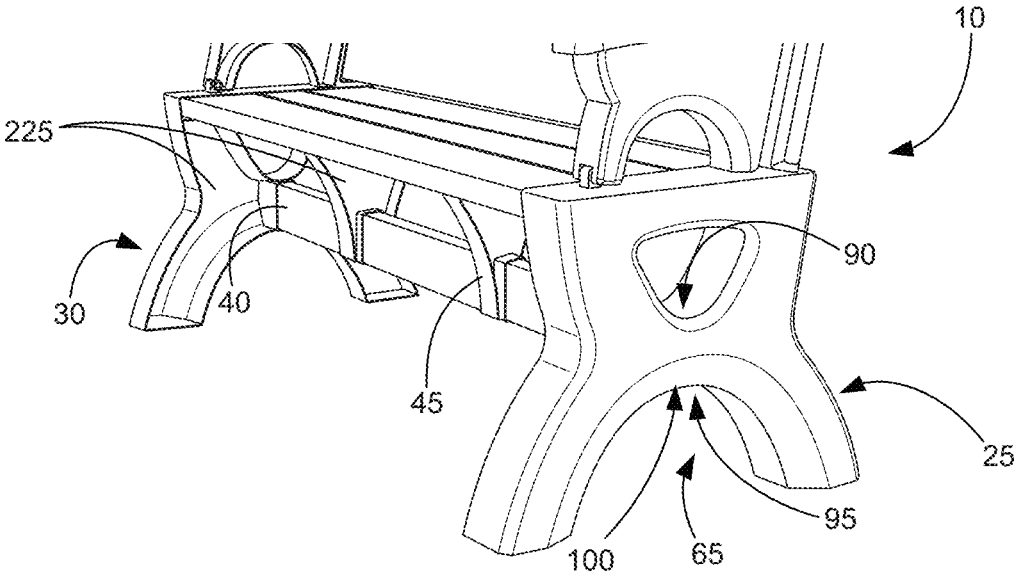

Referring now to the cross member 40, the bench 10 can comprise any suitable support component or components that are configured to span between (and couple to) the end pieces 25 and 30 and to support the bench (e.g., to support the sitting surface 35 via the strut 45 or struts). In this regard, some non-limiting examples of suitable cross members include one or more planks, boards, beams, laths, supports, frameworks, weaves, tethers, sheets, and/or any other suitable materials (e.g., one or more types of polyvinyl chloride, plastics, polymers, wood, stone, ceramics, composites, metals, alloys, natural materials, synthetic materials, wicker, and/or any other suitable material). By way of non-limiting illustration, FIGS. 1, 3, 4, 8, and 10 show some embodiments in which the cross member 40 comprises a substantially straight beam that is coupled to and extends between the end pieces 25 and 30.

Where the base 15 comprises one or more cross members 40, the cross members can couple to the end pieces 25 and 30 in any suitable location, including, without limitation, to an uppermost portion of the end pieces, to a lowermost portion of the end pieces, and/or anywhere there between. In some embodiments, however, each end of the cross member 40 couples (as shown in FIGS. 10 and 14A) to a corresponding end piece (e.g., 30) such the end of the cross member 40 couples to the corresponding arch 65 at or between an uppermost portion 90 and a lowermost portion 95 of an apex (or key) 100 portion of the arch 65. In some other embodiments, however, each end of the cross member spans (or extends on both sides) of an uppermost portion (or edge) of an apex of the arched leg support. In still other embodiments (as illustrated in FIGS. 1 and 14B) each end of the cross member 40 couples to a corresponding end piece (25 or 30) at or above an uppermost lowermost 95 of the apex 100 of the arched leg support 65.

Figure 3:
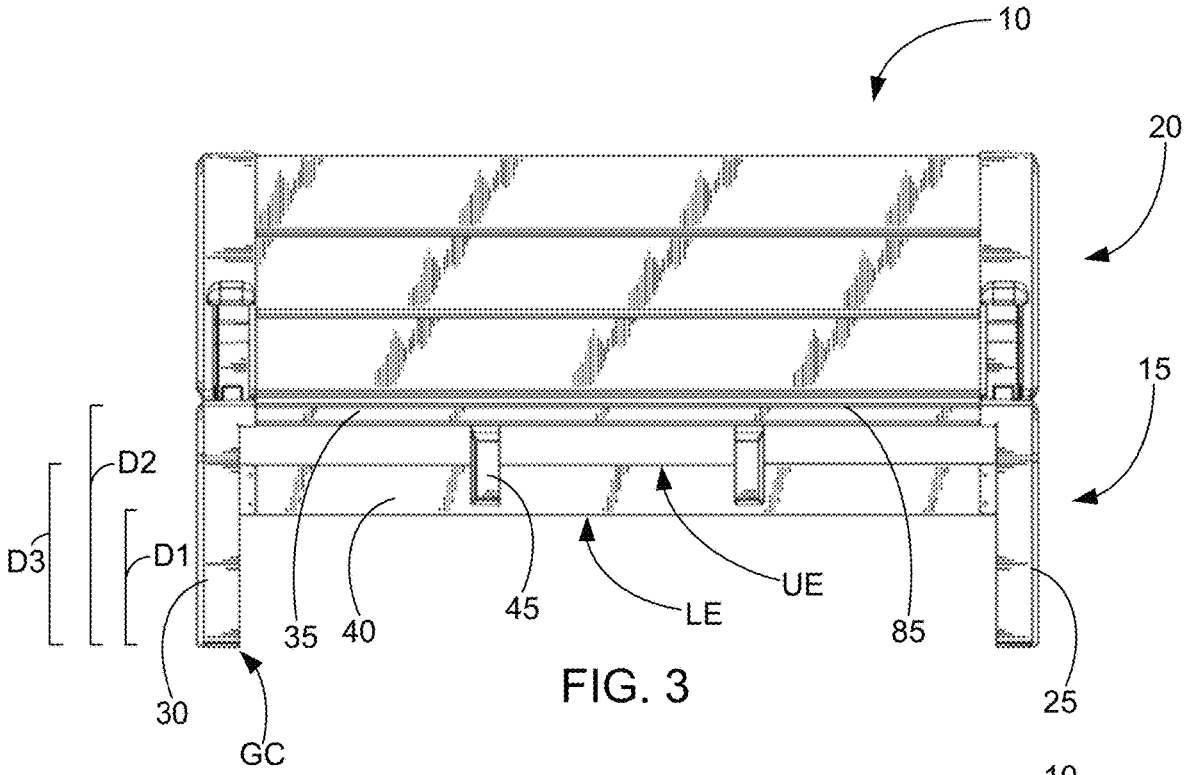
FIG. 3 illustrates a front elevation view of the convertible bench of FIG. 1.
Figure 4:
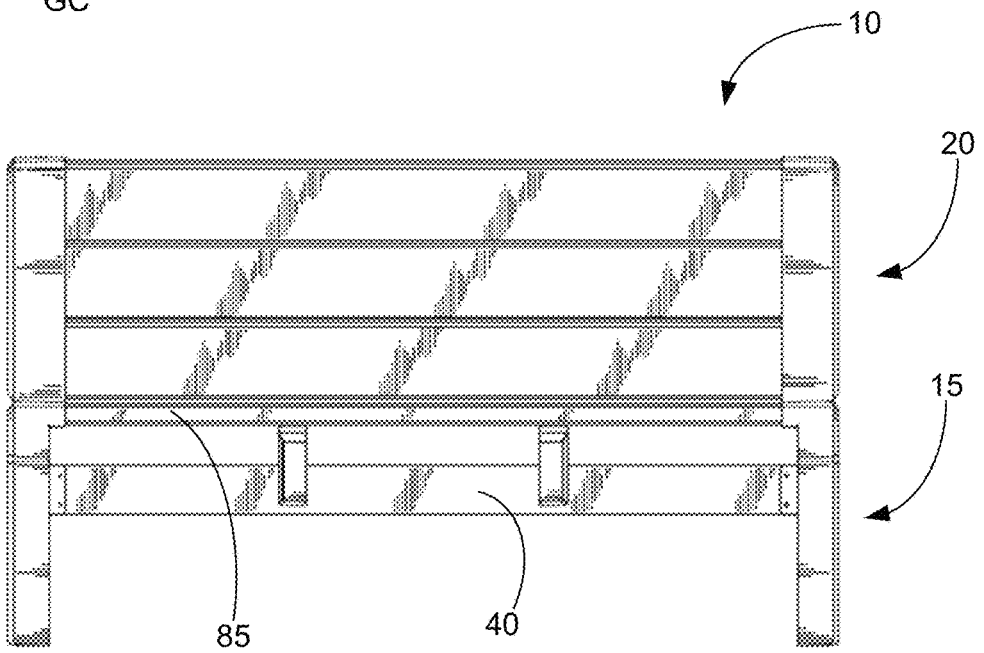
FIG. 4 illustrates a back elevation view of the convertible bench of FIG. 1.
Figure 5:
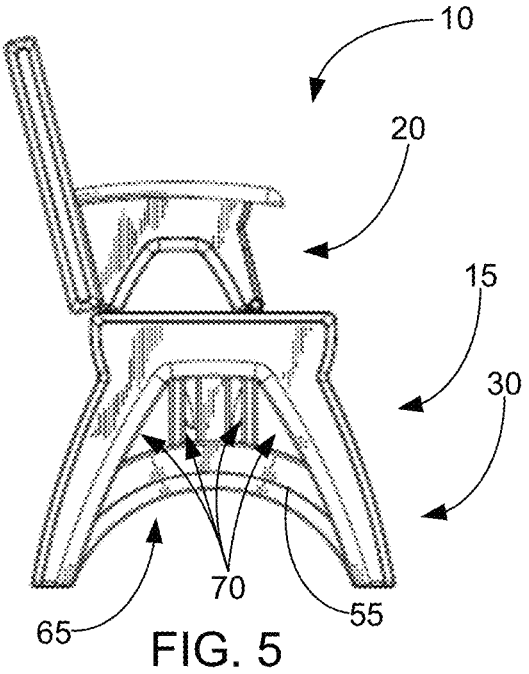
FIGS. 5-6 each illustrate a side elevation view of the convertible bench of FIG. 1.

The cross member 40 (or cross members) can be located any suitable vertical distance between a ground contact portion of the legs 50 and the sitting surface 40 of the bench 10. In some embodiments, however, the vertical distance (as shown in FIG. 3 by D1) between a lower edge (as shown by LE in FIG. 3) of the cross member 40 and the ground contact portion (as shown by GC in FIG. 3) of the legs 50 is between about 35% and about 90% of the vertical distance (as shown by D2 in FIG. 3) (or any subrange thereof) between the ground contact portion GC of the legs 50 and the actual sitting surface (or the top surface) of the sitting surface 35. Indeed, in some embodiments, the lower edge LE of the cross member is disposed at a distance D1 that is between about 45% and about 80% (e.g., between about 48% and about 58%) of the vertical distance D2 between the ground contact portion GC of the legs 50 and the top surface of the sitting surface 35. In some cases, the lower edge LE of the cross member is between about 50% and about 56% of the vertical distance D2 between the ground contact portion GC of the legs 50 and the top surface of the sitting surface 35. For instance, in some embodiments in which D2 is about 17 inches, D1 is about 9 inches±1 inch.

Additionally, an upper edge (as shown by UE in FIG. 3) of the cross member 40 (or cross members) can be disposed any suitable vertical distance between the ground contact portion GC of the legs 50 and the top surface of the sitting surface 40 of the bench 10. In some non-limiting embodiments, the upper edge UE of the cross member 40 is disposed at a vertical distance (as shown by D3 in FIG. 3) of between about 55% and about 99% (or any subrange thereof) of the vertical distance D2 between the ground contact portion GC of the legs 50 and the top surface of the sitting surface 35. Indeed, in some embodiments, the upper edge UE of the cross member 40 is disposed at a vertical distance D3 between about 70% and about 85% (e.g., between about 71% and about 80%) of the vertical distance D2 between the ground contact portion GC of the legs 50 and the top surface of the sitting surface 35. In some embodiments, the upper edge UE of the cross member 40 is disposed at a vertical distance D3 between about 72% and about 76% of the vertical distance D2 between the ground contact portion GC of the legs 50 and the top surface of the sitting surface 35. For instance, in some embodiments in which D2 is about 17 inches, D3 is about 12.5 inches±1 inch.

In accordance with some embodiments, the coupling of the cross member 40 at and/or above an uppermost portion 90 of the apex 100 of the arched leg support 65, and/or so as to have its lower edge LE be raised above that of other competing devices (e.g., above about 45% of the vertical distance D2 between the ground contact portion GC of the legs 50 and the top surface of the sitting surface 35) provides the bench 10 with one or more features. Indeed, in some embodiments, by disposing the cross member on or above the arched leg supports (including, without limitation, at an apex of the arch), the arched leg supports are able to provide the bench with more strength, while requiring less material to construct the bench. Additionally, in some embodiments, by disposing the cross member at or above the arched leg supports, the space between the cross member and the sitting surface 35 is reduced. As a result, in some such embodiments, the size of the struts is reduced such that the amount of material needed (and weight of) the bench 10 is reduced. As an added benefit, in some such cases, the cross member and struts are raised up under the sitting surface, thus hiding such components of the bench. Indeed, by raising the cross member up to a higher height than may be found in some competing devices and/or by placing the support at the apex of the arch, some embodiments of the described bench are configured to support surprisingly greater sitting loads while using less material (e.g., resin). Accordingly, such a raised cross member can be highly desirable.

Turning now to the backrest/table portion 20 of the convertible bench 10, the backrest/table portion can comprise any suitable component that allows the backrest/table portion to convert between a sitting surface with a backrest (e.g., as shown in FIG. 1) and a sitting surface with a table (e.g., as shown in FIG. 2). By way of non-limiting illustration, FIG. 15 shows that, in some embodiments, the backrest/table portion 20 comprises one or more armrest bases 105, armrest caps 110, end supports 115, support elements 120, and/or hinges 125.

With respect to the armrest base 105, the armrest base can comprise any suitable feature that allows it to pivotally couple the support elements 120 and end supports 115 to the bench's base 15. Indeed, in some cases, the armrest base comprises a first pivot joint (e.g., one or more tongue and groove hinges, gate hinges, strap hinges, butt hinges, flush hinges, barrel hinges, spring hinges, pivot joints, ball and socket joints, and/or any other suitable pivoting mechanism) that pivotally couples the armrest base to a corresponding end piece 25 or 30. In some embodiments, however, the armrest base 105 is coupled to the base 15 through the use of one or more tongue and groove hinges (e.g., as shown at hinge 125 in FIGS. 15 and 16).

Figure 15:
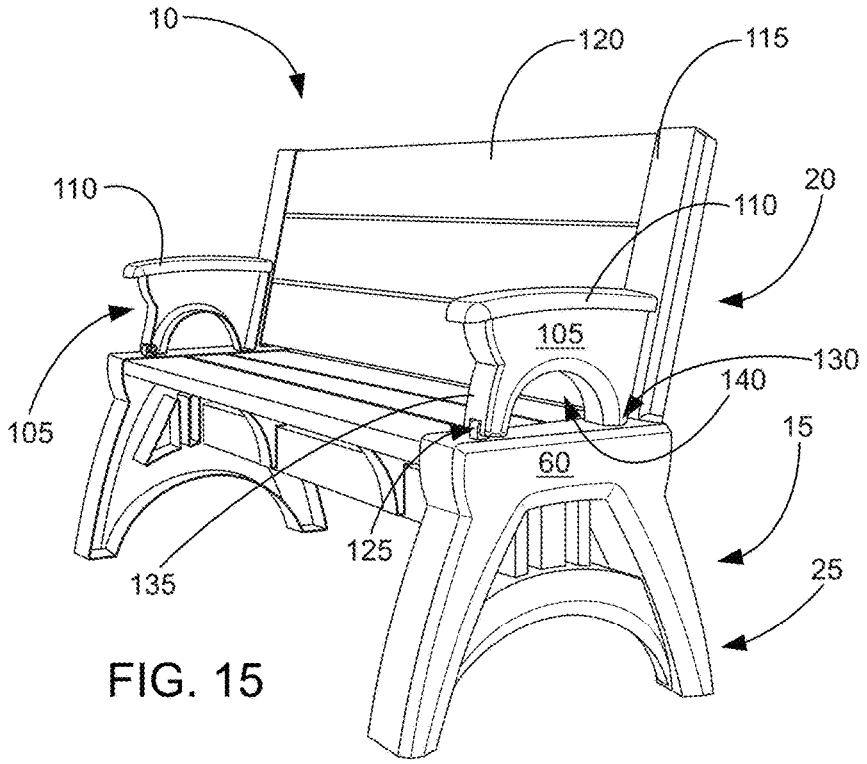
FIGS. 15-16 each illustrate a perspective view of the convertible bench having an armrest base defining an arched recess in accordance with some embodiments.
Figure 16:
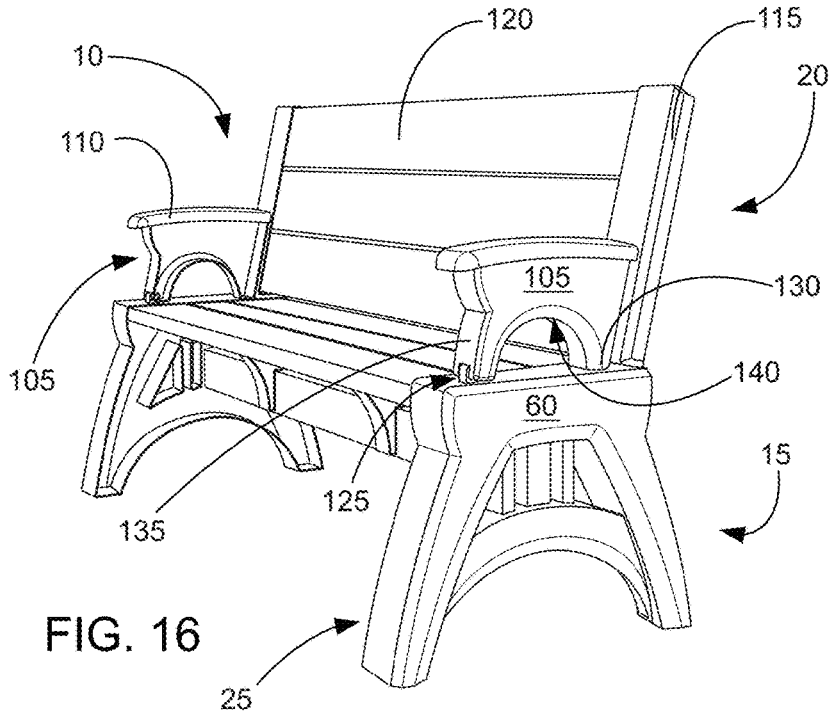
Figure 17:
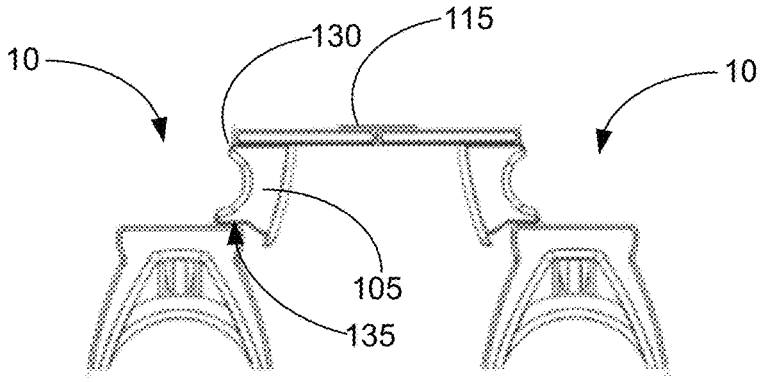
FIG. 17 illustrates a side elevation view of two convertible benches placed in proximity to each other in accordance with a representative embodiment.

Additionally, as illustrated in FIGS. 15-16, in accordance with some embodiments, each armrest base 105 further comprises a first contact surface 130 that is configured to contact a first portion of the corresponding end piece 25 or 30 (e.g., an uppermost, back portion of the sitting surface support 60) when the backrest/table portion 20 is in the first position (e.g., as shown in FIGS. 15-16). Additionally, in some embodiments, each armrest base 105 further comprises a second contact surface 135 that is configured to contact a second portion of the corresponding end piece (e.g., an uppermost, front portion of the sitting surface support 60) when the backrest/table is in the second position (e.g., as shown in FIG. 17). In this regard, the term front portion of an end piece can refer to a portion of the end piece that comprises the pivot joint (e.g., 125).

Although each armrest base 105 can have any suitable shape, in some cases, each armrest base defines an arch-shaped recess that is disposed between the first pivot joint (e.g., hinge 125) and the first contact surface 130. In this regard, the arch-shaped recess can have any suitable arch shape, including, without limitation, any arch shape discussed herein. By way of non-limiting illustration, FIG. 15 shows an embodiment in which the arch-shaped recess 140 comprises a rounded (or one-centered) arch. Additionally, FIG. 16 shows that, in some embodiments, the arch-shaped recess 140 comprises a trapezoidal arch. In any case, some embodiments of the arch-shaped recess provides increased strength to the armrest base, while significantly reducing the amount of material needed to produce such embodiments the armrest component (e.g., the armrest base and the armrest cap 110).

With respect to the armrest caps 110, the caps can have any suitable characteristic that allows the bench 10 to function as described herein. Indeed, in some embodiments, the armrest caps each comprise an uppermost surface that: is substantially flat, is rounded from side to side, defines a recess that is configured to cradle a length of a user's forearm, is arch-shaped, is bowed, and/or that has any other suitable characteristic that allows the bench to function as described. By way of non-limiting illustration, FIGS. 15-16 show some embodiments in which the armrest cap 110 is arch-shaped. In some such embodiments, the arch shape of the armrest cap strengthens the armrest component (e.g., the armrest cap and the armrest base 105) such that the armrest base can define a relatively large recess (e.g., recess 140) while still properly supporting the backrest/table portion 20 when the bench is in the second position.

Where an armrest base 105 comprises the first 130 and/or second 135 contact surfaces, the contact surfaces can comprise any suitable characteristic, including, without limitation, a substantially flat contact surface, a foot, a process, mating contact surface, and/or any other suitable contact surface or characteristic that allows the armrest base to function as described herein. By way of non-limiting illustration, FIGS. 15-16 show some embodiments in which the first contact surface 130 comprises a foot that is configured to contact a back top portion of the corresponding end piece (e.g., 25) when the bench 10 is in the first position. Additionally, FIGS. 15-16 show some embodiments in which the second contact surface 135 comprises a substantially flat surface that is configured to contact a front top portion of the corresponding end piece (e.g., 25) when the bench 10 is in the second position (e.g., as shown in FIG. 17). In this regard, when the bench is in the first position, the substantially flat surface of the second contact surface 135 can run at any suitable angle (see angle α in FIG. 18A) with respect to an upper surface of a corresponding end piece (25 or 30), including, without limitation, between about 30 degrees and about 115 degrees (or in any subrange thereof). Indeed, in some embodiments, the substantially flat portion of the second contact surface runs at an angle between about 60 degrees and about 80 degrees. In some embodiments, however, the substantially flat portion of the second contact surface runs at an angle (e.g., 75 degrees±5 degrees) that allows the support members 120 to provide a level tabletop when the bench is in the second position.

With reference now to the end supports 115, the backrest/table portion 20 can comprise an any suitable component that is configured to couple to and support one or more support elements 120 so that such elements are configured to function as a backrest when the bench 10 is in the first position and as a tabletop when the bench is in the second position. By way of non-limiting illustration, FIGS. 15-17 show some embodiments in which each end support 115 comprises an elongated object that extends from the armrest base member 105 and is coupled (e.g., that receives, is fastened to, is adhered to, is formed with, and/or is otherwise coupled) to one or more support elements 120.

Figure 18A:
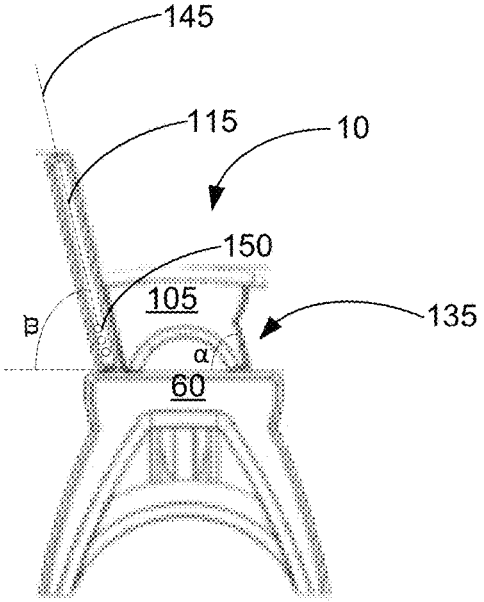
FIG. 18A illustrates a side elevation view of an embodiment of the convertible bench.
Figure 18B:
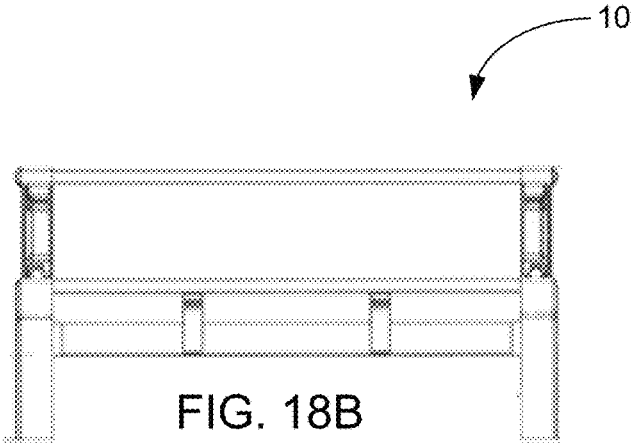
FIG. 18B illustrates a back elevation view of an embodiment of the convertible bench in the second position.

When the bench 10 is in the first position (e.g., as shown in FIG. 18A), a longitudinal axis 145 of the end supports 115 can run at any suitable angle that allows the backrest/table portion 20 to function as a backrest. Indeed, in some embodiments, when the bench is in the first position, the longitudinal axis of the end supports 115 runs at an angle between about 30 degrees and about 115 degrees (or in any subrange thereof) with respect to an upper surface of the corresponding end piece 25 or 30. Indeed, in some embodiments the longitudinal axis of the end supports runs at an angle (e.g., (3, as shown in FIG. 18A) that is between about 60 degrees and about 80 degrees. In some embodiments, however, the longitudinal axis runs at an angle (e.g., 70 degrees±10 degrees) that allows the support members to provide a backrest having a comfortable incline for a user.

Figure 19A:
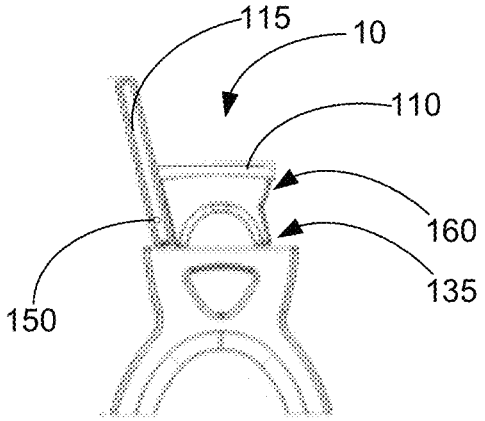
FIG. 19A illustrates a side elevation view of an embodiment of the convertible bench.
Figure 19B:
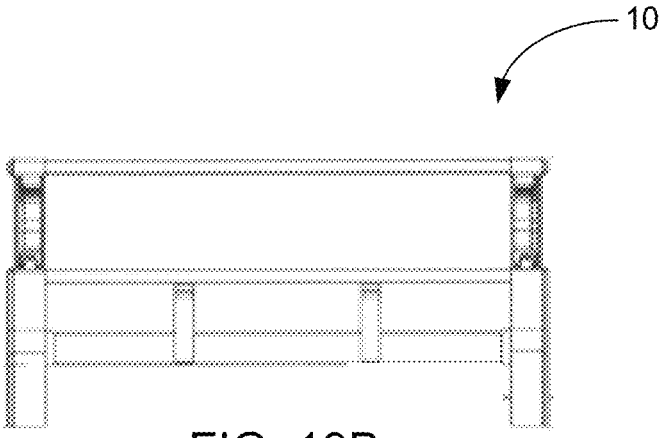
FIG. 19B illustrates a back elevation view of an embodiment of the convertible bench in the second position.
Figure 20A:
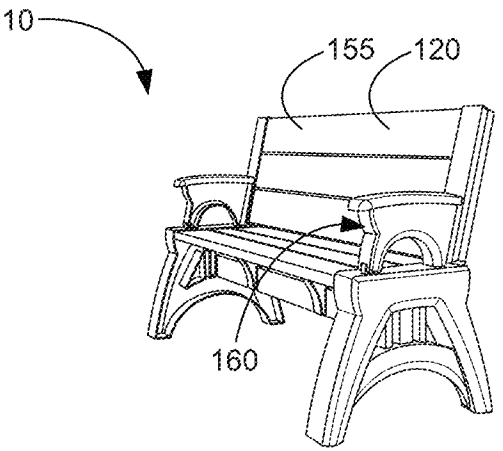
FIGS. 20A-20D illustrate perspective views of some embodiments of the convertible bench.
Figure 20B:
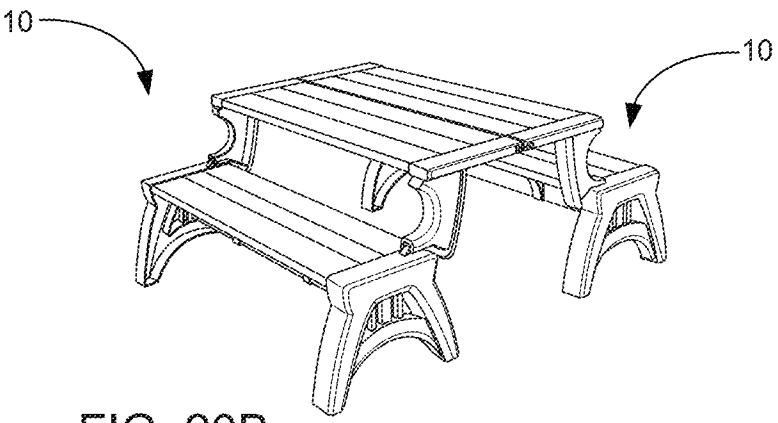
Figure 20C:
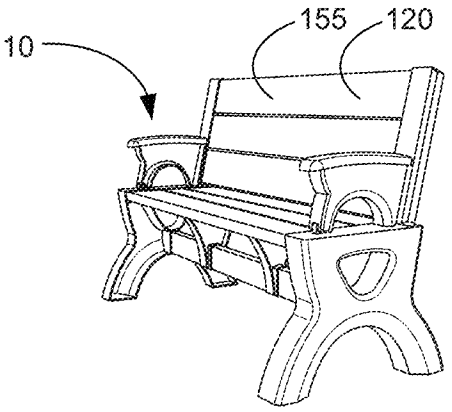
Figure 20D:
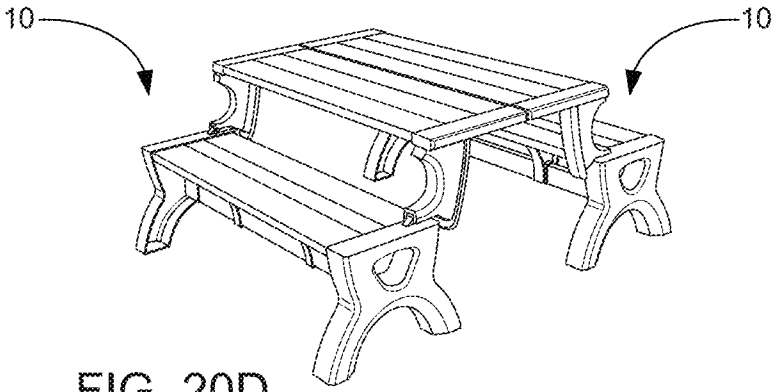

In some cases, when the bench 10 is in the first position, the substantially flat surface of the second contact surface 135 of the armrest base 105 runs at an angle α that is substantially parallel to the angle β of the longitudinal axis 145 of the end supports 115. In some other embodiments, however, the substantially flat surface of the second contact surface 135 of the armrest bases runs at an angle α that is not parallel (e.g., at a bisecting angle) to the angle β of the longitudinal axis of the end supports. Indeed, while in some embodiments the angle β of the longitudinal axis of the end supports is limited (or only is movable in one direction to a certain point) when the bench is in the first position, in some embodiments, the backrest/table portion comprises one or more adjustment mechanisms that are configured to selectively adjust the angle of the end supports (and/or to otherwise vary the slope of the bench's backrest) when the bench is in the first position. In this regard, the bench can comprise any suitable adjustment mechanism that is configured to perform such a function, including, without limitation, one or more mechanisms that are configured to change a length of the end supports, to raise and/or lower a portion of the first contact surface 130, to raise and/or lower a portion of the end piece 25 or 30 that is configured to contact the first contact surface, and/or to otherwise adjust an angle of the backrest in any suitable manner when the bench is in the first position. By way of non-limiting illustration, FIG. 19A shows an embodiment in which the end support comprises a bar (not shown) that is configured to be moved into and out of the end support 115 and to be locked in place by placing a pawl (not shown) through a hole 150 in the end support and one of a plurality of holes defined along a length of the bar (or vice versa).

With respect now to the support elements 120, the backrest/table portion 20 of the bench 10 can comprise any suitable support elements that are configured to function as a backrest when the bench is in the first position and as a tabletop when the bench is in the second position. Some non-limiting examples of suitable support elements include one or more planks, boards, beams, laths, supports, frameworks, weaves, sheets, and/or any other suitable pieces or types of material, including, but not limited to, one or more types of polyvinyl chloride, plastics, polymers, wood, stone, ceramics, composites, metals, alloys, natural materials, synthetic materials, wicker, and/or any other suitable material. By way of non-limiting illustration, FIGS. 20A-20D show some embodiments in which the support elements 120 comprises 1, 2, 3, 4, 5, 6, 7, or more slats 155. In this regard, such slats can be any suitable size, including, without limitation, being about 1.5 inches (±1 inch) in height, by about 3.5 inches (±3 inches) in width, and by any suitable length (e.g., between about 1 foot and about 50 feet, or in any subrange thereof, such as between about 2 feet and about 10 feet; see e.g., FIGS. 13A-13G). Additionally, while the planks 85 and the slats are the same size in some embodiments, in some other embodiments, at least some of the planks 85 and the slats 155 are different sizes (e.g., as illustrated in FIGS. 13A-13G and FIG. 1).

In addition to the aforementioned components, the described bench 10 can comprise any other suitable component that allows it to function as intended. In one example, some embodiments of the bench optionally comprise one or more buttresses and/or other supports that extend from the armrest base 105 (e.g., above the substantially flat surface of the second contact surface 135) and that provide additional support to the armrest cap 110. While such a buttress can have any suitable shape, FIGS. 19A-20A show some embodiments in which the buttress 160 comprises a convex and/or arched surface. Again, while such a buttress can perform any suitable function, in some embodiments, it allows the armrest base 105 to define a relatively large arched recess 140, while still providing the armrest base to function as intended.

Figure 21B:
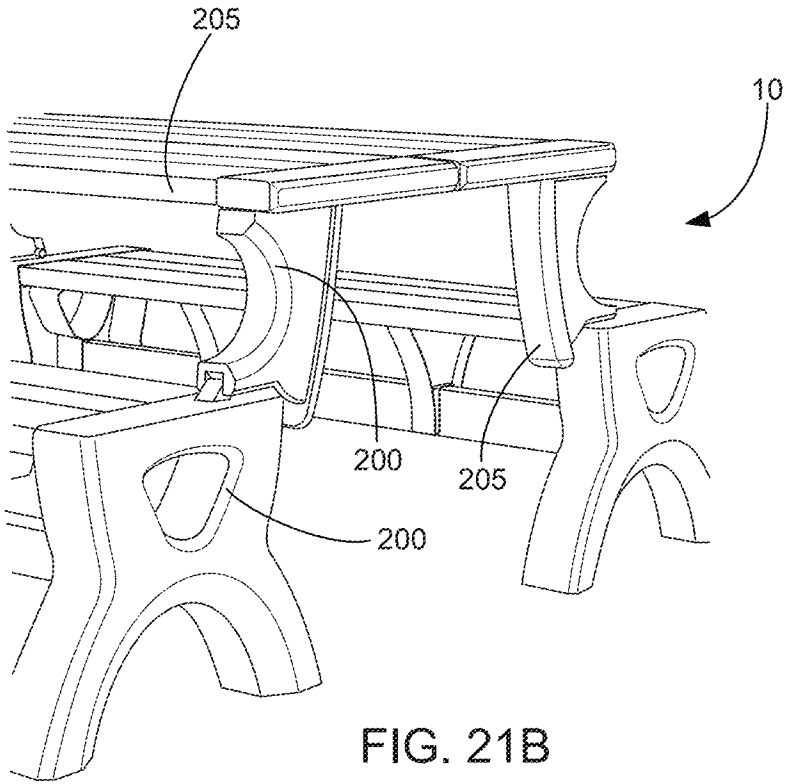
FIGS. 21A-21B each illustrate a perspective view of a portion of two convertible benches placed in proximity to each other in accordance with some embodiments.
Figure 21A:
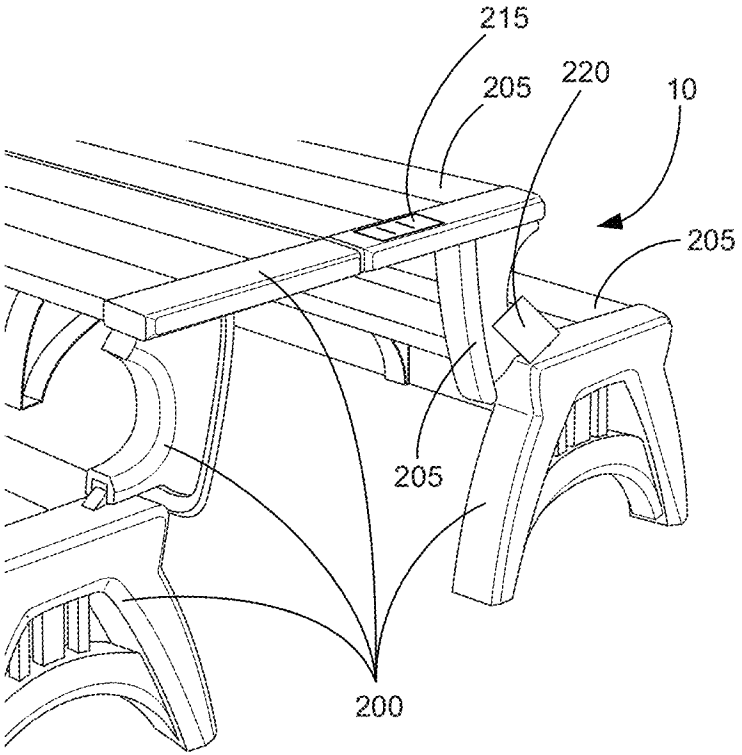

As another example of a suitable modification, in some embodiments, the bench 10 comprises one or more lights, speakers (e.g., Bluetooth speakers, a radio with one or more speakers, an MP3 and/or any other suitable audio player with one or more speakers, and/or any other suitable speaker system), video displays, cameras, light sensors, thermometers, sensors, pressure sensors, pinch sensors (e.g., to ensure that movement of the backrest/table portion 20 between the first and second positions (and vice versa) does not pinch and harm anyone), and/or any other suitable component. By way of non-limiting illustration, FIG. 21A shows that in some embodiments, the bench 10 comprise one or more motors 220, geared motors, servos, actuators, hydraulic actuators, pneumatic actuators, linear actuators, geared actuators, geared mechanisms, worm drive mechanisms, and/or other mechanisms that are configured to selectively move the backrest/table portion 20 (e.g., between the first and second positions).

Where the bench 10 comprises one or more motors 220, lights, speakers, displays, sensors, audio players, and/or any other suitable electronic components, such components can be powered in any suitable manner, including, without limitation, be being plugged into the mains, by being battery powered, by being solar powered, and/or in any other suitable manner. By way of non-limiting illustration, FIG. 21A shows an embodiment in which the motor 220 is electrically coupled to one or more solar cells 215 that are disposed on the bench 10 or that are otherwise in electric communication with the motor (and/or other electrical component).

In still another example of a suitable modification, one or more edges of the bench 10 and its various components are squared, rounded, chamfered, curved, and/or otherwise have any other suitable shape. By way of non-limiting example, FIGS. 21A-21B show that in some embodiments, edges of the bench 10 are chamfered 200 and rounded 205.

Figure 22:
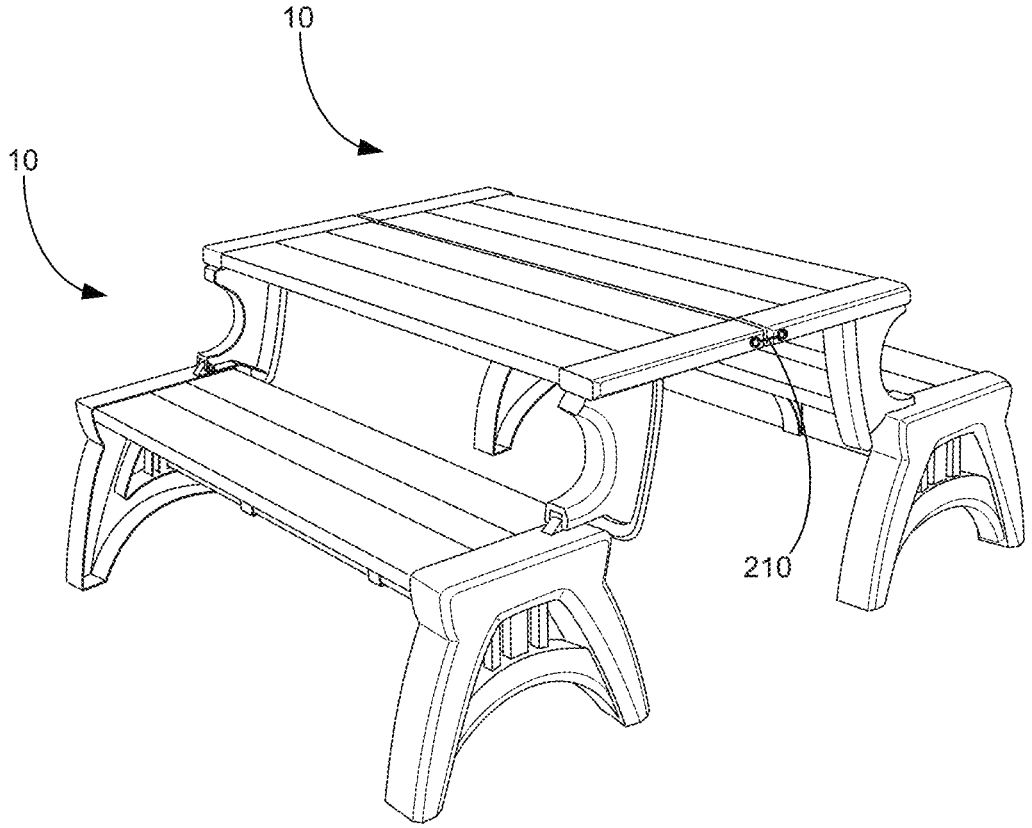
FIG. 22 illustrates a perspective view showing two convertible benches coupled together.
Figure 23:
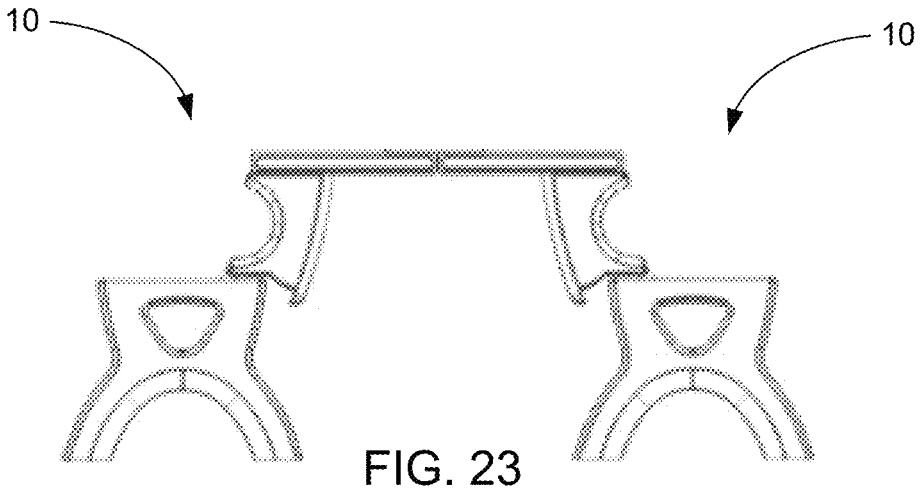
FIG. 23 illustrates a side elevation view of two convertible benches disposed in proximity to each other in accordance with a representative embodiment.

In still another example, in some embodiments two convertible benches 10 are disposed in proximity to each other (e.g., to form a table, as shown in FIGS. 22 and 23). In some embodiments, when the convertible benches are in the second position and are placed in proximity to each other, the two benches are not physically coupled to each other (e.g., remain separate from each other, even if they touch each other). In some other embodiments, however, the two benches are configured to couple with each other when they are in the second position. In this regard, the two benches can couple with each other in any suitable manner, including, without limitation, through the use of one or more catches, hooks, hook and loop fasteners, straps, clamps, braces, frictional engagements, mechanical engagements, and/or any other suitable coupling mechanisms. By way of non-limiting illustration, FIG. 22 shows an embodiment in which two convertible benches 10 are coupled with a strap mechanism 210.

Figure 24A:
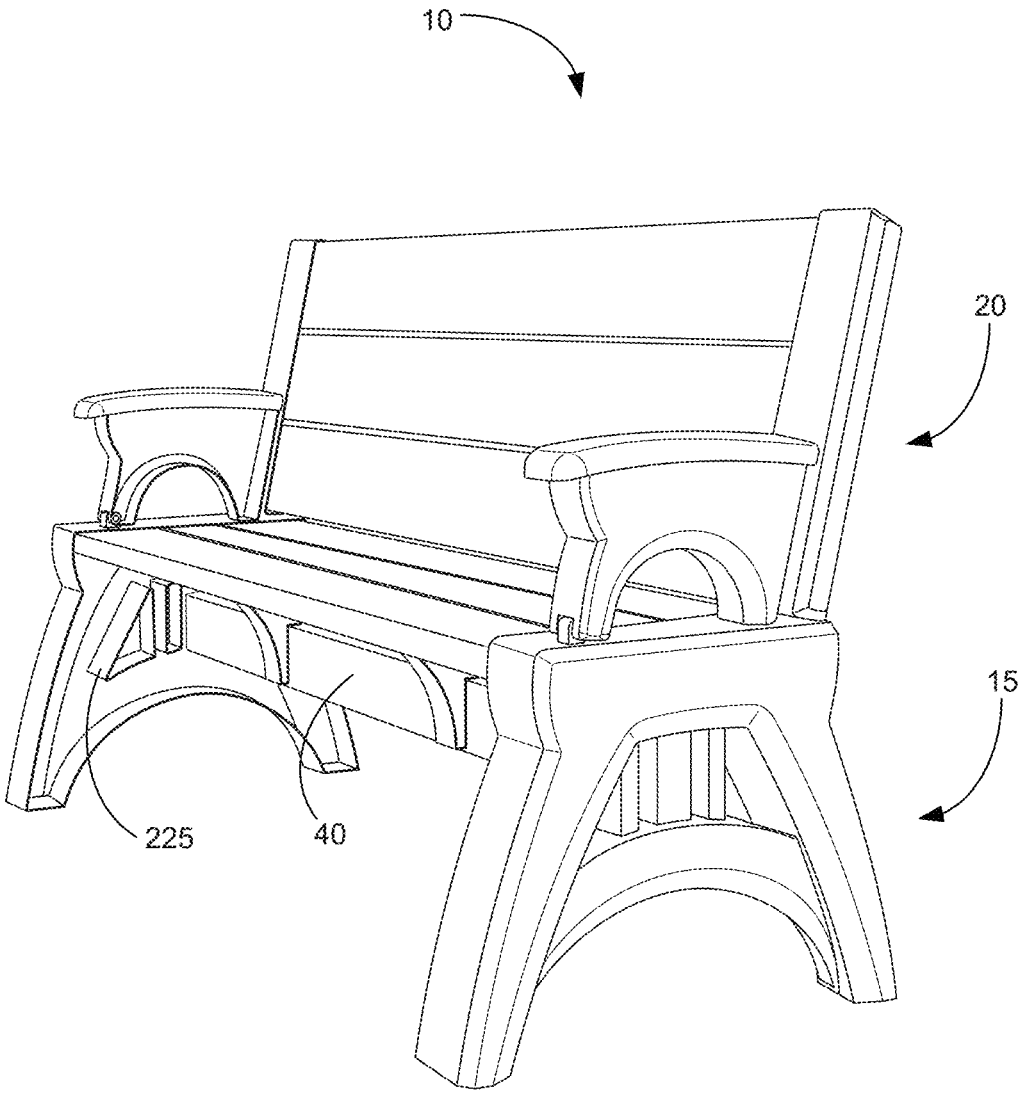
FIGS. 24A-24B show some embodiments in which the convertible bench is in the first position and the second position, respectively.
Figure 24B:
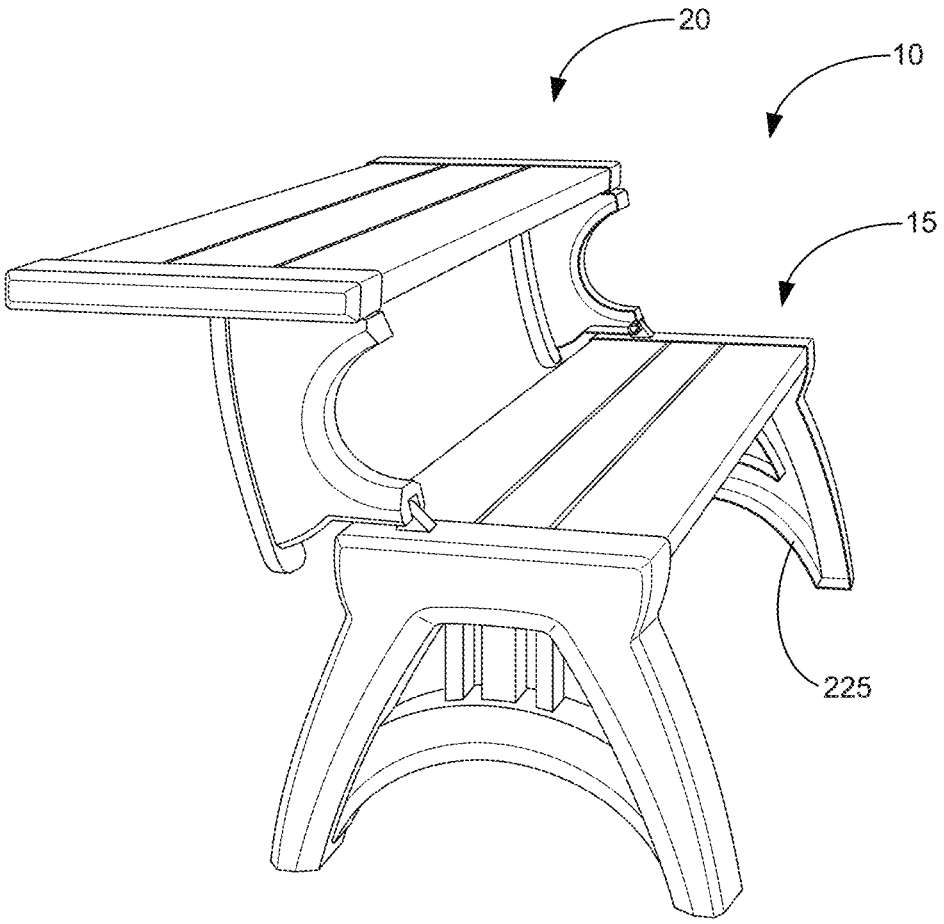
Figure 24C:
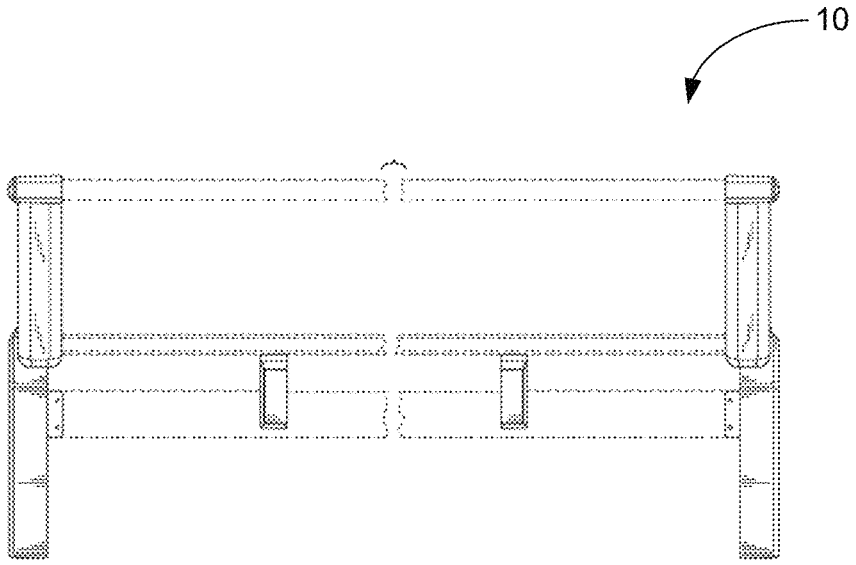
FIGS. 24C-24H show various views in which the convertible bench is in the second position.
Figure 24D:
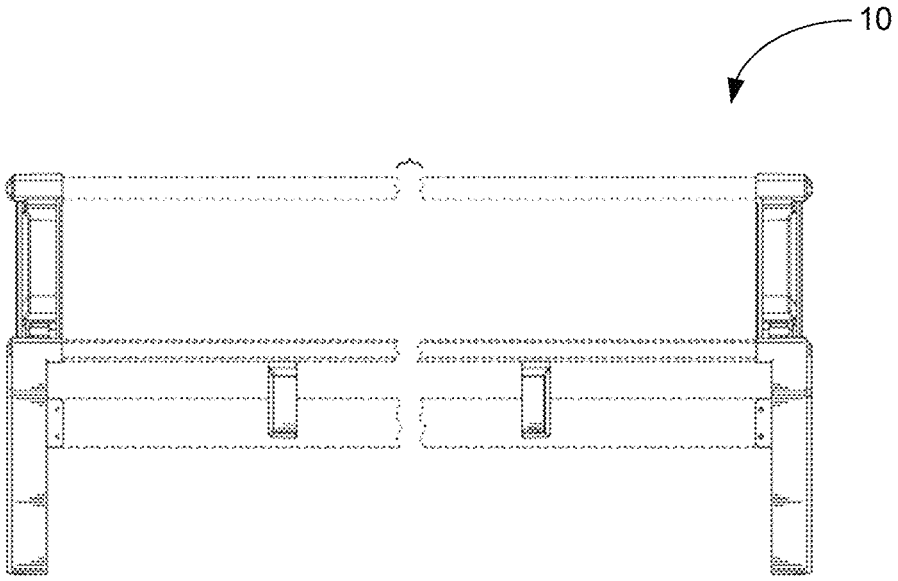
Figure 24E:
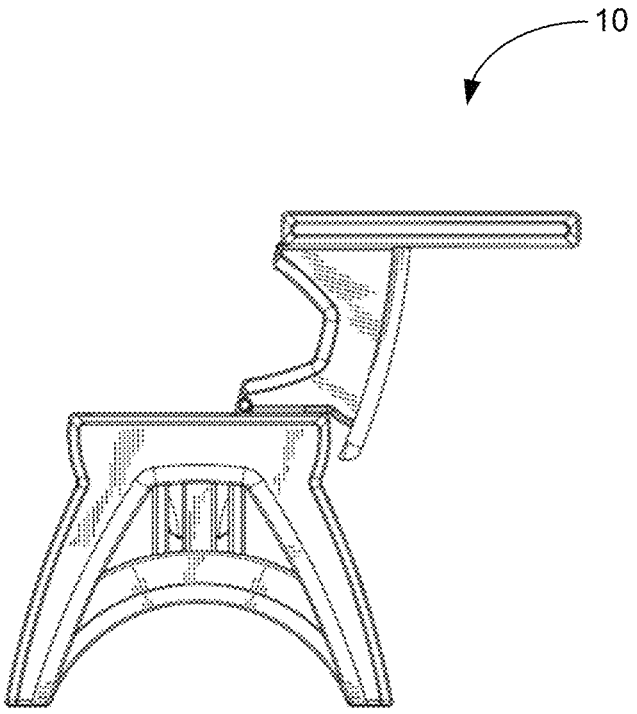
Figure 24F:
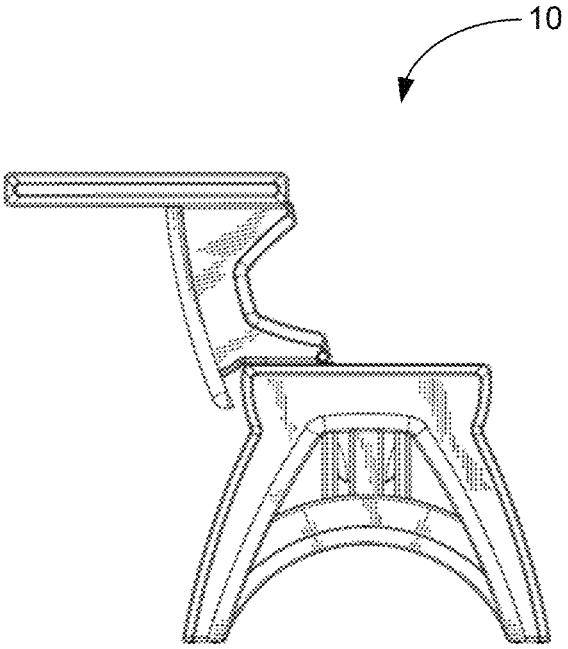
Figure 24G:
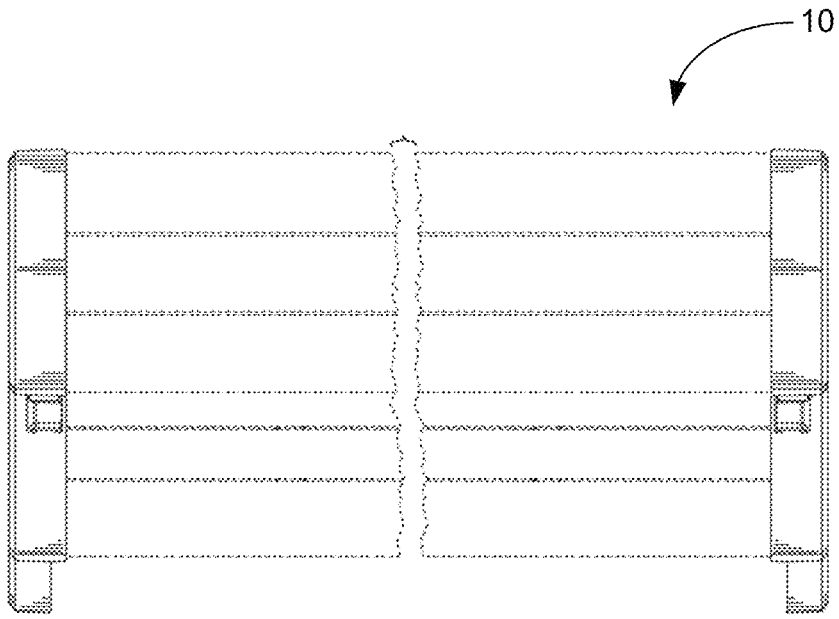
Figure 24H:
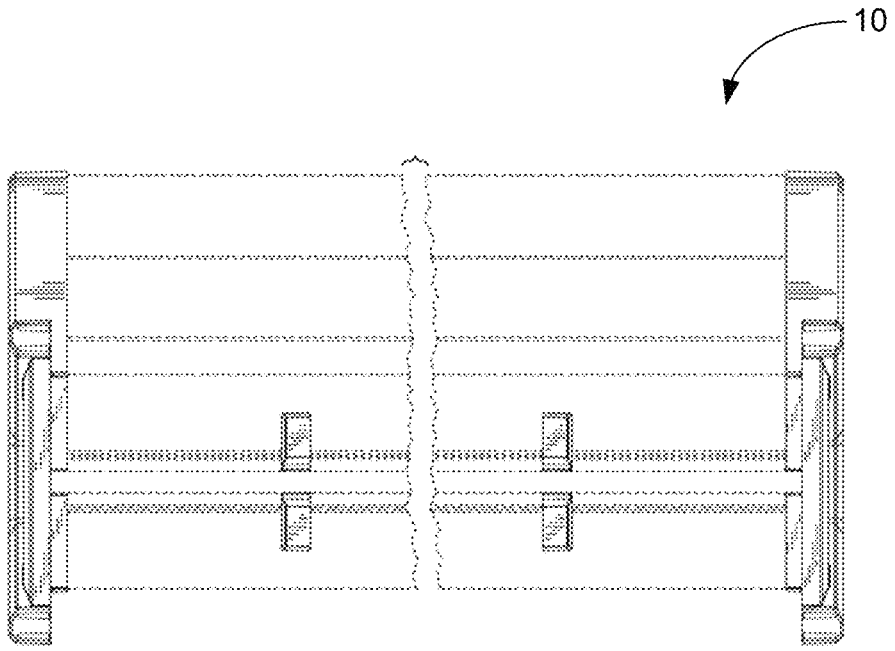

As still another example of a suitable modification, the bench 10 can comprise any suitable number and type of supports or ribs. By way of non-limiting example, FIGS. 24A-24B show some embodiments in which the one or more edges and/or internal components of the bench 10 comprise a ribbed surface 225 to strengthen the bench. In this regard, because of the arched leg support 65, the arched armrest cap 110, the arched opening 70, the arched recess 140, and/or the other characteristics set forth herein, some embodiments of the bench are relatively strong while comprising fewer ribs than would otherwise be necessary.

In still another example of a suitable modification, in some embodiments, a length and/or a height of the bench 10 is configured to be adjusted. In this regard, the length and/or height of the bench can be adjusted in any suitable manner. In some embodiments, the cross member 40, planks 85, slats 155, and/or any other suitable components of the bench are configured to be interchanged with cross members, planks, slats, and/or other components of a different length. Additionally, in some embodiments, the cross members, planks, and/or slats are configured to selectively telescope to increase and/or decrease in size. In still other embodiments, a length of the bench is configured to be increased and/or decreased by the addition or removal of one or more "leaves" or other inserts that are configured to be selectively added to and/or removed from the bench.

In some embodiments, the legs 50 and/or any other portions of the bench 10 are configured to be selectively extended and/or shortened to raise and/or lower the sitting surface 35 of the bench. In this regard, the sitting surface of the bench can be raised and/or lowered in any suitable manner, including, without limitation, by having the sitting surface be configured to selectively couple to the end pieces 25 and 30 at a plurality of different heights, by having the legs telescope, by having one or more inserts be configured to be selectively added to and/or removed from the legs and/or any other suitable portion of the bench, and/or in any other suitable manner.

The various components of the described bench 10 can comprise any suitable material, including, without limitation, one or more types of: polyvinyl chloride, plastic (e.g., polyethylene, high density polyethylene plastic, ultra-high-molecular-weight polyethylene, polypropylene, PVC sheet board, and/or any other suitable plastics), polymer, resin, metal (e.g., one more types of steel, aluminum, and/or any other suitable metal), metal alloys, ceramics, fiberglass, rubbers, polymers, pre-preg. aramid fibers, woods, carbon fibers, natural materials, synthetic materials, ultra-high-molecular weight (UHMW) materials (e.g., ultra-high-molecular weight polyethylene and/or other UHMW materials), and/or any other suitable materials. Indeed, in some embodiments, the bench comprises one or more types of polyvinyl chloride.

The described system 10 can also be made in any suitable manner. In this regard, some non-limiting examples of methods for making the described bench include, injection molding, extruding, cutting, folding, bending, shaping, drilling, using a computer numerical control device, connecting various pieces with one or more adhesives, mechanical fasteners (e.g., clamps, rivets, crimps, pins, brads, nails, staples, pegs, clips, screws, bolts, threaded attachments, couplers, etc.), 3D printing, additive manufacturing, welding pieces together, connecting pieces together, and/or any other suitable method that allows the described system to perform its intended functions. Indeed, in accordance with some embodiments, each end piece 25 and 30 comprises an integrally formed monolithic element.

In addition to the aforementioned features, the described convertible bench 10 can have any other suitable feature. Indeed, in some embodiments, by comprising the various arched portions (e.g., 65, 110, 140, etc.) and/or arch shaped openings 70, the convertible bench can be stronger and hold more weight than may some conventional benches. Additionally, as a result of the arched portions and openings 70, some embodiments of the bench require less material (e.g., PVC and/or any other material) to construct the bench. As a result, some embodiments of the bench are lighter and less expensive to produce than are some competing pieces of furniture. Moreover, as a result of the structural features discussed herein, some embodiments of the bench (as mentioned) require fewer internal supports (e.g., fins 225, as shown in FIGS. 14A-14B)—again allowing the bench to be lighter, stronger, and/or less expensive to build than some competing pieces of furniture. In some cases, by having the bench be lighter, it can be easier to ship, easier to move, and/or otherwise provide the bench with one or more other desirable characteristics.

Thus, some embodiments of the current invention relate to furniture. More particularly, some embodiments of the described invention relate to systems and methods for providing a convertible bench that is configured to move between a first position, which presents a backrest, and a second position, which presents a tabletop. While the described bench can include any suitable component, in some cases, it includes a base having a first end piece that has a first set of legs with a first arched leg support that extends between the first set of legs and a second end piece having a second set of legs with a second arched leg support that extends between the second set of legs. The bench further includes a backrest/table portion that is hingedly coupled to the base so as to be pivotable from the first position that presents the backrest to a second position that presents the tabletop. In some cases, an armrest of the backrest/table portion defines an arched recess that provides strength to the armrest while reducing an amount of material needed to produce the armrest.

The present invention may be embodied in other specific forms without departing from its spirit or essential characteristics. The described embodiments, examples, and illustrations are to be considered in all respects only as illustrative and not restrictive. The scope of the invention is, therefore, indicated by the appended claims rather than by the foregoing description. Each of the various elements of the described embodiments, implementations, figures, and examples can be mixed and matched with each other in any suitable manner. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front back, on top of, below, above, top, bottom, side, up, down, under, over, upper, lower, lateral, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A convertible bench comprising:

a base having:

a first end piece having:

a front leg portion;

a rear leg portion;

an upper arcuate shaped member; and a lower arcuate shaped member, wherein the upper and lower arcuate shaped members are coupled to the front leg portion and the rear leg portion, and wherein the lower arcuate shaped member is recessed in from a laterally outermost edge of at least one of the front leg portion and the rear leg portion;

a sitting surface support that is disposed adjacent to the upper arcuate shaped member;

a second end piece;

a cross member that extends between, and that couples to both of, the first end piece and the second end piece, such that a first end of the cross member is disposed between an apex of the lower arcuate shaped member and the sitting surface support, wherein the first end spans a majority of a distance between the apex of the lower arcuate shaped member and the sitting surface support; and a backrest/table portion that is pivotally coupled to the base to pivot from a first position to a second position.

2. The convertible bench of claim 1, wherein the first end piece comprises a first vertical support that extends from an apex of the lower arcuate shaped member to a lower portion of the upper arcuate shaped member, and wherein the first vertical support receives the first end of the cross member.

3. The convertible bench of claim 2, wherein the first end piece comprises a second vertical support and a third vertical support that each (i) extend between the lower arcuate shaped member and the upper arcuate shaped member and (ii) have a width less than the first vertical support.

4. The convertible bench of claim 3, wherein the first end piece defines an opening between the upper arcuate shaped member and the lower arcuate shaped member, wherein each of the first vertical support, the second vertical support, and the third vertical support extend across the opening, leaving open space on either side of each of the first vertical support, the second vertical support and the third vertical support.

5. The convertible bench of claim 1, further comprising a sitting surface comprising a plurality of planks coupled to the sitting surface support and extending between the first end piece and the second end piece, wherein a vertical gap exists between the sitting surface and the cross member.

6. The convertible bench of claim 5, wherein a vertical distance between an upper edge of the cross member and a ground contact portion is between about 55% and about 99% of a vertical distance between the ground contact portion of the first end piece and a top surface of the sitting surface.

7. The convertible bench of claim 5, further comprising a strut that is coupled to the cross member and fans out to contact the sitting surface.

8. The convertible bench of claim 1, wherein the backrest/table portion presents a backrest in the first position and a tabletop in the second position, wherein the backrest/table portion comprises an armrest base that is pivotally coupled to the first end piece via a pivot joint, wherein the armrest base comprises: a first contact surface that is configured to contact the first end piece, on a first side of the pivot joint, when the backrest/table portion is in the first position, and a second contact surface that is configured to contact the first end piece, on a second side of the pivot joint, when the backrest/table portion is in the second position, and wherein the armrest base defines an arch-shaped recess that is disposed between the pivot joint and the first contact surface such that the armrest base defines the arch-shaped recess between the armrest base and the first end piece when the backrest/table portion is in the first position.

9. A convertible bench comprising:
- a base having:
  - a first end piece having:
    - a front leg portion;
    - a rear leg portion;
    - an upper arcuate shaped member; and
    - a lower arcuate shaped member, wherein the upper and lower arcuate shaped members are coupled to the front leg portion and the rear leg portion, wherein the lower arcuate shaped member is recessed in from a laterally outermost edge of at least one of the front leg portion and the rear leg portion, and wherein the first end piece defines a through-opening between the upper arcuate shaped member and the lower arcuate shaped member;
    - a vertical support coupled to the upper arcuate shaped member and the lower arcuate shaped member, wherein the vertical support divides the through-opening between the upper arcuate shaped member and the lower arcuate shaped member;
  - a sitting surface support that is disposed adjacent to the upper arcuate shaped member;
  - a second end piece;
  - a cross member that extends between, and that couples to both of, the first end piece and the second end piece; and
- a backrest/table portion that is pivotally coupled to the base to pivot from a first position to a second position.

10. The convertible bench of claim 9, wherein the vertical support extends from an apex of the lower arcuate shaped member to a lower portion of the upper arcuate shaped member, and wherein the vertical support receives a first end of the cross member.

11. The convertible bench of claim 9, wherein the first end piece comprises a second vertical support and a third vertical support that each (i) extend between the lower arcuate shaped member and the upper arcuate shaped member and (ii) have a width less than the first vertical support.

12. The convertible bench of claim 9, further comprising a sitting surface comprising a plurality of planks coupled to the sitting surface support and extending between the first end piece and the second end piece, wherein a vertical gap exists between the sitting surface and the cross member.

13. The convertible bench of claim 12, further comprising a strut that is coupled to the cross member and fans out to contact the sitting surface.

14. The convertible bench of claim 9, wherein the backrest/table portion presents a backrest in the first position and a tabletop in the second position, wherein the backrest/table portion comprises an armrest base that is pivotally coupled to the first end piece via a pivot joint, wherein the armrest base comprises: a first contact surface that is configured to contact the first end piece, on a first side of the pivot joint, when the backrest/table portion is in the first position, and a second contact surface that is configured to contact the first end piece, on a second side of the pivot joint, when the backrest/table portion is in the second position, and wherein the armrest base defines an arch-shaped recess that is disposed between the pivot joint and the first contact surface such that the armrest base defines the arch-shaped recess between the armrest base and the first end piece when the backrest/table portion is in the first position.

15. A convertible bench, comprising:
- a base having:
  - a first end piece having:
    - a front leg portion;
    - a rear leg portion;
    - an upper arcuate shaped member; and
    - a lower arcuate shaped member, wherein the upper and lower arcuate shaped members are coupled to the front leg portion and the rear leg portion, and wherein the lower arcuate shaped member is recessed in from a laterally outermost edge of at least one of the front leg portion and the rear leg portion;
  - a sitting surface support that is disposed adjacent to the upper arcuate shaped member;
  - a second end piece;
  - a cross member that is substantially centered front to rear in the base and extends between, and that couples to both of, the first end piece and the second end piece;
  - a cross member support member comprising walls that form a socket, the walls interconnecting the lower arcuate shaped member and the upper arcuate shaped member, wherein the cross member support member receives and couples to an end of the cross member; and
- a backrest/table portion that is pivotally coupled to the base to pivot from a first position to a second position.

16. The convertible bench of claim 15, wherein the cross member support member is flanked on each side by a pair of vertical supports, wherein the pair of vertical supports each extend from the lower arcuate shaped member to the upper arcuate shaped member.

17. The convertible bench of claim 16, wherein each of the cross member support member and the pair of vertical supports is recessed in from a laterally outermost edge of the lower arcuate shaped member.

18. The convertible bench of claim 15, further comprising a sitting surface comprising a plurality of planks coupled to the sitting surface support and extending between the first end piece and the second end piece, wherein a vertical gap exists between the sitting surface and the cross member.

19. The convertible bench of claim 18, further comprising a strut that is coupled to the cross member and fans out to contact the sitting surface.

20. The convertible bench of claim 15, wherein a lower portion of the lower arcuate shaped member comprises an arcuate chamfered surface.

* * * * *